US009955277B1

(12) United States Patent
Alexandridis et al.

(10) Patent No.: US 9,955,277 B1
(45) Date of Patent: Apr. 24, 2018

(54) SPATIAL SOUND CHARACTERIZATION APPARATUSES, METHODS AND SYSTEMS

(71) Applicant: Foundation for Research and Technology—Hellas (F.O.R.T.H.) Institute of Computer Science (I.C.S.), Heraklion (GR)

(72) Inventors: Anastasios Alexandridis, Heraklion (GR); Anthony Griffin, Crete (GR); Athanasios Mouchtaris, Filothei (GR)

(73) Assignee: FOUNDATION FOR RESEARCH AND TECHNOLOGY-HELLAS (F.O.R.T.H.) INSTITUTE OF COMPUTER SCIENCE (I.C.S.), Heraklion (GR)

( * ) Notice: Subject to any disclaimer, the term of this patent is extended or adjusted under 35 U.S.C. 154(b) by 236 days.

(21) Appl. No.: 14/294,095

(22) Filed: Jun. 2, 2014

Related U.S. Application Data

(63) Continuation-in-part of application No. 14/038,726, filed on Sep. 26, 2013, now Pat. No. 9,554,203.

(60) Provisional application No. 61/829,760, filed on May 31, 2013, provisional application No. 61/706,073, filed on Sep. 26, 2012.

(51) Int. Cl.
*H04S 5/00* (2006.01)

(52) U.S. Cl.
CPC ..... *H04S 5/00* (2013.01)

(58) Field of Classification Search
CPC ..... H04R 2410/01; H04R 2430/21; H04R 2430/20; H04R 2430/23; H04R 25/40; H04R 5/027; H04S 3/002; G10L 2021/02166; H04M 3/568
USPC ..... 381/91–92, 122, 22, 23
See application file for complete search history.

(56) References Cited

U.S. PATENT DOCUMENTS

| | | | | |
|---|---|---|---|---|
| 7,555,161 | B2 | 6/2009 | Haddon et al. | |
| 7,826,623 | B2 | 11/2010 | Christoph | |
| 8,073,287 | B1 | 12/2011 | Wechsler et al. | |
| 8,923,529 | B2 | 12/2014 | McCowan | |
| 2008/0089531 | A1 | 4/2008 | Koga et al. | |
| 2009/0080666 | A1 * | 3/2009 | Uhle | H04R 5/04 381/17 |

(Continued)

OTHER PUBLICATIONS

M. Cobos et al., "On the use of small microphone arrays for wave field synthesis auralization," Proceedings of the 45th International Conference: Applications of Time-Frequency Processing in Audio Engineering Society Conference, Mar. 2012.

(Continued)

*Primary Examiner* — George C Monikang
(74) *Attorney, Agent, or Firm* — Norton Rose Fulbright US LLP

(57) ABSTRACT

A processor-implemented method for spatial sound characterization is described. In one implementation, each of a plurality of source signals detected by a plurality of sensing devices, is segmented into a plurality of time frames. For each time frame, time-frequency transform of the source signals is derived, an estimated number of sources and at least one estimated direction of arrival corresponding to each of the source signals is obtained. Further, source signals are extracted by spatial separation based at least on the estimated directions of arrival and the estimated number of sources, and separated source signals are processed to yield a reference signal and side information.

20 Claims, 7 Drawing Sheets

(56) References Cited

U.S. PATENT DOCUMENTS

| | | | | |
|---|---|---|---|---|
| 2010/0135511 | A1* | 6/2010 | Pontoppidan | H04R 25/505 381/313 |
| 2010/0142327 | A1 | 6/2010 | Kepesi et al. | |
| 2010/0217590 | A1 | 8/2010 | Nemer et al. | |
| 2010/0278357 | A1 | 11/2010 | Hiroe | |
| 2011/0033063 | A1* | 2/2011 | McGrath | H04R 3/005 381/92 |
| 2011/0091055 | A1 | 4/2011 | LeBlanc | |
| 2011/0110531 | A1 | 5/2011 | Klefenz et al. | |
| 2012/0020485 | A1 | 1/2012 | Visser et al. | |
| 2012/0051548 | A1 | 3/2012 | Visser et al. | |
| 2012/0114126 | A1* | 5/2012 | Thiergart | G10L 21/0272 381/17 |
| 2012/0140947 | A1 | 6/2012 | Shin | |
| 2012/0221131 | A1 | 8/2012 | Wang et al. | |
| 2013/0108066 | A1 | 5/2013 | Hyun et al. | |
| 2013/0142343 | A1 | 6/2013 | Matsui et al. | |
| 2013/0216047 | A1 | 8/2013 | Kuech et al. | |
| 2013/0259243 | A1 | 10/2013 | Herre et al. | |
| 2013/0268280 | A1 | 10/2013 | Del Galdo et al. | |
| 2013/0272548 | A1* | 10/2013 | Visser | G06K 9/00624 381/122 |
| 2013/0287225 | A1 | 10/2013 | Niwa et al. | |
| 2014/0025374 | A1 | 1/2014 | Lou | |
| 2014/0172435 | A1 | 6/2014 | Thiergart et al. | |
| 2014/0376728 | A1 | 12/2014 | Rämö et al. | |
| 2015/0310857 | A1 | 10/2015 | Habets et al. | |

OTHER PUBLICATIONS

H. Hacihabiboglu and Z. Cvetkovic, "Panoramic recording and reproduction of multichannel audio using a circular microphone array," in Proceedings of the IEEE Workshop on Applications of Signal Processing to Audio and Acoustics (WASPAA 2009), pp. 117-120, Oct. 2009.

K. Niwa et al., "Encoding large array signals into a 3D sound field representation for selective listening point audio based on blind source separation," in Proceedings of the IEEE International Conference on Acoustics, Speech and Signal Processing (ICASSP 2008), pp. 181-184, Apr. 2008.

V. Pulkki, "Spatial sound reproduction with directional audio coding," Journal of the Audio Engineering Society, vol. 55, No. 6, pp. 503-516, Jun. 2007.

F. Kuech et al., "Directional audio coding using planar microphone arrays," in Proceedings of the Hands-free Speech Communication and Microphone Arrays (HSCMA), pp. 37-40, May 2008.

O. Thiergart et al., "Parametric spatial sound processing using linear microphone arrays," in Proceedings of Microelectronic Systems, A. Heuberger, G. Elst, and R.Hanke, Eds., pp. 321-329, Springer, Berlin, Germany, 2011.

M. Kallinger et al., "Enhanced direction estimation using microphone arrays for directional audio coding," in Proceedings of the Hands-free Speech Communication and Microphone Arrays (HSCMA), pp. 45-48, May 2008.

M. Cobos et al., "A sparsity-based approach to 3D binaural sound synthesis using time-frequency array processing," Eurasip Journal on Advances in Signal Processing, vol. 2010, Article ID 415840, 2010.

B. Loesch et al., "Multidimensional localization of multiple sound sources using frequency domain ICA and an extended state coherence transform," *IEEE/SP 15th Workshop Statistical Signal Processing* (*SSP*), pp. 677-680, Sep. 2009.

A. Lombard et al., "TDOA estimation for multiple sound sources in noisy and reverberant environments using broadband independent component analysis," *IEEE Transactions on Audio, Speech, and Language Processing*, pp. 1490-1503, vol. 19, No. 6, Aug. 2011.

H. Sawada et al., "Multiple source localization using independent component analysis," *IEEE Antennas and Propagation Society International Symposium*, pp. 81-84, vol. 4B, Jul. 2005.

F. Nesta and M. Omologo, "Generalized state coherence transform for multidimensional TDOA estimation of multiple sources," *IEEE Transactions on Audio, Speech, and Language Processing*, pp. 246-260, vol. 20, No. 1, Jan. 2012.

M. Swartling et al., "Source localization for multiple speech sources using low complexity non-parametric source separation and clustering," in *Signal Processing*, pp. 1781-1788, vol. 91, Issue 8, Aug. 2011.

C. Blandin et al., "Multi-source TDOA estimation in reverberant audio using angular spectra and clustering," in *Signal Processing*, vol. 92, No. 8, pp. 1950-1960, Aug. 2012.

D. Pavlidi et al., "Real-time multiple sound source localization using a circular microphone array based on single-source confidence measures," in *International Conference on Acoustics, Speech and Signal Processing* (*ICASSP*), pp. 2625-2628, Mar. 2012.

O. Yilmaz and S. Rickard, "Blind separation of speech mixtures via time-frequency masking," *IEEE Transactions on Audio, Speech, and Language Processing*, pp. 1830-1847, vol. 52, No. 7, Jul. 2004.

E. Fishler et al., "Detection of signals by information theoretic criteria: General asymptotic performance analysis," in *IEEE Transactions on Signal Processing*, pp. 1027-1036, vol. 50, No. 5, May 2002.

M. Puigt and Y. Deville, "A new time-frequency correlation-based source separation method for attenuated and time shifted mixtures," in *8th International Workshop on Electronics, Control, Modelling, Measurement and Signals 2007 and Doctoral School* (*EDSYS,GEET*), pp. 34-39, May 28-30, 2007.

G. Hamerly and C. Elkan, "Learning the k in k-means," in *Neural Information Processing Systems*, Cambridge, MA, USA: MIT Press, pp. 281-288, 2003.

B. Loesch and B. Yang, "Source number estimation and clustering for underdetermined blind source separation," in *Proceedings International Workshop Acoustic Echo Noise Control* (*IWAENC*), 2008.

S. Araki et al., "Stereo source separation and source counting with MAP estimation with dirichlet prior considering spatial aliasing problem," in *Independent Component Analysis and Signal Separation, Lecture Notes in Computer Science*. Berlin/Heidelberg, Germany: Springer , vol. 5441, pp. 742-750, 2009.

A. Karbasi and A. Sugiyama, "A new DOA estimation method using a circular microphone array," in *Proceedings European Signal Processing Conference* (*EUSIPCO*), 2007, pp. 778-782.

S. Mallat and Z. Zhang, "Matching pursuit with time-frequency dictionaries," *IEEE Transactions on Signal Processing*, vol. 41, No. 12, pp. 3397-3415, Dec. 1993.

D. Pavlidi et al., "Source counting in real-time sound source localization using a circular microphone array," in *Proc. IEEE 7th Sensor Array Multichannel Signal Process. Workshop* (*SAM*), Jun. 2012, pp. 521-524.

A. Griffin et al., "Real-time multiple speaker DOA estimation in a circular microphone array based on matching pursuit," in *Proceedings 20th European Signal Processing Conference* (*EUSIPCO*), Aug. 2012, pp. 2303-2307.

P. Comon and C. Jutten, Handbook of Blind Source Separation: Independent Component Analysis and Applications, ser. Academic Press. Burlington, MA: Elsevier, 2010.

L.M. Kaplan et al., "Bearings-only target localization for an acoustical unattended ground sensor network," *Proceedings of Society of Photo-Optical Instrumentation Engineers* (*SPIE*), vol. 4393, pp. 40-51, 2001.

A. Bishop and P. Pathirana, "Localization of emitters via the intersection of bearing lines: A ghost elimination approach," *IEEE Transactions on Vehicular Technology*, vol. 56, No. 5, pp. 3106-3110, Sep. 2007.

A. Bishop and P. Pathirana, "A discussion on passive location discovery in emitter networks using angle-only measurements," *International Conference on Wireless Communications and Mobile Computing* (*IWCMC*), *ACM*, pp. 1337-1343, Jul. 2006.

J. Reed et al., "Multiple-source localization using line-of-bearing measurements: Approaches to the data association problem," *IEEE Military Communications Conference* (*MILCOM*), pp. 1-7, Nov. 2008.

(56) References Cited

OTHER PUBLICATIONS

A. Alexandridis et al., "Directional coding of audio using a circular microphone array," *IEEE International Conference on Acoustics, Speech and Signal Processing* (*ICASSP*), pp. 296-300, May 2013.
A. Alexandridis et al., "Capturing and Reproducing Spatial Audio Based on a Circular Microphone Array," *Journal of Electrical and Computer Engineering*, vol. 2013, Article ID 718574, pp. 1-16, 2013.
M. Taseska and E. Habets, "Spotforming using distributed microphone arrays," *IEEE Workshop on Applications of Signal Processing to Audio and Acoustics*, Oct. 2013.
S. Rickard and O. Yilmaz, "On the approximate w-disjoint orthogonality of speech," in *Proc. Of ICASSP*, 2002, vol. 1, pp. 529-532.
N. Ito et al., "Designing the wiener post-filter for diffuse noise suppression using imaginary parts of inter-channel cross-spectra," in *Proc. Of ICASSP*, 2010, pp. 2818-2821.
D. Pavlidi et al., "Real-time sound source localization and counting using a circular microphone array," *IEEE Trans. on Audio Speech, and Lang. Process*, vol. 21, No. 10, pp. 2193-2206, 2013.
L. Parra and C. Alvino, "Geometric source separation: merging convolutive source separation with geometric beamforming," *IEEE Transactions on Speech and Audio Processing*, vol. 10, No. 6, pp. 352-362, 2002.
V. Pulkki, "Virtual sound source positioning using vector based amplitude panning," *J. Audio Eng. Soc*., vol. 45, No. 6, pp. 456-466, 1997.
J. Usher and J. Benesty, "Enhancement of spatial sound quality: A new reverberation-extraction audio upmixer," *IEEE Trans. on Audio Speech, and Lang. Process*, vol. 15, No. 7, pp. 2141-2150, 2007.
C. Faller and F. Baumgarte, "Binaural cue coding-part ii: Schemes and application," *IEEE Trans. on Speech and Audio Process*, vol. 11, No. 6, pp. 520-531, 2003.
M. Briand, et al., "Parametric representation of multichannel audio based on principal component analysis," in *AES 120$^{th}$ Conv*., 2006.
M. Goodwin and J. Jot., "Primary-ambient signal decomposition and vector-based localization for spatial audio codding and enhancement," in *Proc. Of ICASSP*, 2007, vol. 1, pp. 1-9.
J. He et al., "A study on the frequency-domain primary-ambient extraction for stereo audio signals," in *Proc. Of ICASSP*, 2014, pp. 2892-2896.
J. He et al., "Linear estimation based primary-ambient extraction for stereo audio signals," *IEEE Trans. on Audio, Speech and Lang. Process*., vol. 22, pp. 505-517, 2014.
C. Avendano and J. Jot, "A frequency domain approach to multichannel upmix," *J. Audio Eng. Soc*, vol. 52, No. 7/8, pp. 740-749, 2004.
O. Thiergart et al. "Diffuseness estimation with high temporal resolution via spatial coherence between virtual first-order microphones," in *Applications of Signal Processing to Audio and Acoustics* (*WASPAA*), 2011, pp. 217-220.
G. Carter et al, "Estimation of the magnitude-squared coherence function via overlapped fast fourier transform processing," *IEEE Trans. on Audio and Electroacoustics*, vol. 21, No. 4, pp. 337-344, 1973.
I. Santamaria and J. Via, "Estimation of the magnitude squared coherence spectrum based on reduced-rank canonical coordinates," in *Proc. Of ICASSP*, 2007, vol. 3, pp. III-985.
D. Ramirez, J. Via and I. Santamaria, "A generalization of the magnitude squared coherence spectrum for more than two signals: definition, properties and estimation," in *Proc. Of ICASSP*, 2008, pp. 3769-3772.
B. Cron and C. Sherman, "Spatial-correlation functions for various noise models," *J. Acoust. Soc. Amer*., vol. 34, pp. 1732-1736, 1962.
H. Cox et al., "Robust adaptive beamforming," *IEEE Trans. on Acoust., Speech and Signal Process*., vol. 35, pp. 1365-1376, 1987.
H. K. Maganti, D. Gatica-Perez, I. McCowan, "Speech Enhancement and Recognition in Meetings with Audio-Visual Sensor Array," IEEE Transactions on Audio, Speech, and Language Processing, vol. 15, No. 8, Nov. 2007.

* cited by examiner (a)

SPATIAL SOUND CHARACTERIZATION APPARATUSES, METHODS AND SYSTEMS

CROSS-REFERENCE TO RELATED APPLICATIONS

This application claims priority under 35 U.S.C. § 119 to U.S. Provisional Patent Application No. 61/829,760, filed May 31, 2013, which is expressly incorporated by reference herein in its entirety.

This application is a continuation-in-part of U.S. patent application Ser. No. 14/038,726 titled, "Sound Source Characterization Apparatuses, Methods and Systems," filed on Sep. 26, 2013, which claims benefit of U.S. Provisional Patent Application No. 61/706,073, filed on Sep. 26, 2012, both of which are expressly incorporated by reference herein in their entirety.

This application may contain material subject to copyright or other intellectual property protection. The respective owners of such intellectual property have no objection to the facsimile reproduction of the disclosure as it appears in documents published by the U.S. Patent and Trademark Office, but otherwise reserve all rights whatsoever.

BACKGROUND

The subject matter disclosed herein relates generally to apparatuses, methods, and systems for sound source localization and using the source localization for spatial sound separation and more particularly, to SPATIAL SOUND CHARACTERIZATION APPARATUSES, METHODS, AND SYSTEMS ("SSC").

SUMMARY

This summary is not intended to identify essential features of the claimed subject matter nor is it intended for use in determining or limiting the scope of the claimed subject matter.

A processor-implemented method for spatial sound characterization is described. In one implementation, each of a plurality of source signals detected by a plurality of sensing devices, is segmented into a plurality of time frames. For each time frame, a time-frequency transform of the source signals is derived, an estimated number of sources and at least one estimated direction of arrival corresponding to each of the source signals is obtained. Further, source signals are extracted by spatial separation based at least on the estimated directions of arrival and the estimated number of sources, and separated source signals are processed to yield a monophonic reference signal and side information, which can be used on the encoder side to reproduce spatial sound.

BRIEF DESCRIPTION OF THE DRAWINGS

Exemplary embodiments of the SSC are described with reference to the accompanying figures. In the figures, the left-most digit(s) of a reference number identifies the figure in which the reference number first appears. The same numbers are used throughout the figures to reference like features and components.

Figure 1:
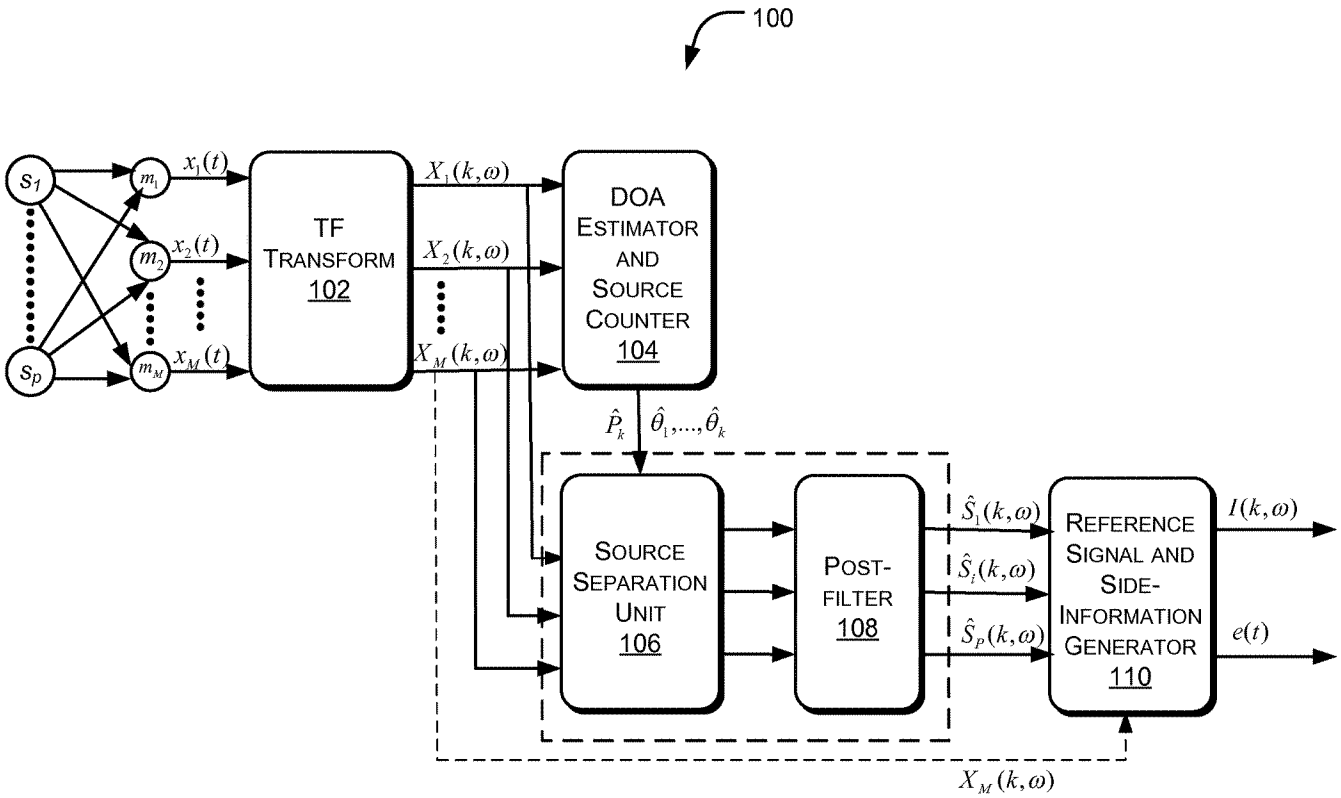
FIG. 1 is an exemplary block diagram of an SSC system configured to obtain and process sound signals to capture spatial sound characterization information, according to an embodiment of the present subject matter.

It should be appreciated by those skilled in the art that any block diagrams herein represent conceptual views of illustrative systems. Similarly, it should be appreciated that any flow charts, flow diagrams, state transition diagrams, pseudo code, and the like represent various processes, which may be substantially represented in a computer readable medium and so executed by a computer or processor, whether or not such computer or processor is explicitly shown.

DETAILED DESCRIPTION

SPATIAL SOUND CHARACTERIZATION APPARATUSES, METHODS AND SYSTEMS ("SSC") are described herein.

Overview

To enable a listener with a surround sound experience, spatial sound recording and reproducing has garnered attention from audio researchers. Examples of applications include, but are not limited to, entertainment systems for reproducing concerts, playing movies, playing video games, and teleconferencing. Some embodiments of SSC may comprise a plurality of devices, such as microphones, capable of detecting mechanical waves, such as sound, from one or two sources. In one implementation, the devices are arranged in a circular array. In other implementations, the devices may be arranged in other configurations, such as triangle, square, straight or curved line or any other configuration. For example, in some embodiments, devices such as microphones may be arranged in a uniform circular array to detect sound signals from at least one sound source. Some embodiments may be configured to work with various types of microphones (e.g. dynamic, condenser, piezoelectric, MEMS and the like) and signals (e.g. analog and digital). The microphones may or may not be equispaced and the location of each microphone relative to a reference point and relative to each other may be known. Some embodiments may or may not comprise one or more sound sources, of which the position relative to the microphones may be known. Even though the description mostly discusses audible sound waves, it will be understood that the SSC may be configured to accommodate signals in the entire range of frequencies and may also accommodate other types of signals (e.g. electromagnetic waves and the like).

Microphones may be used in conjunction with various methods to capture spatial sound and localize sound sources, such as to determine the direction of arrival of signals from the sound sources in a variety of scenarios. For example, methods may be used to determine the location of speakers in a room during a teleconference. Such methods either focus on scenarios where only a single sound source or microphone is active, or provide computationally intensive solutions that cannot be executed efficiently in real-time where multiple sound sources are active simultaneously. Other methods rely on the assumption that sources do not overlap in small windows of time, which may true hold for speech in anechoic environments but not in reverberant conditions.

According to an embodiment, the SSC includes methods and systems for capturing and reproducing spatial audio information based at least on sound localization information from multiple, simultaneously active sources. According to an implementation, the SSC may be configured to: count the number of active sources at each time instant or at predefined time intervals; estimate the directions of arrival of the active sound sources on a per time-frame basis; and perform source separation with a beamformer. For example, a fixed superdirective beamformer may be implemented, which results in more accurate modeling and reproduction of the recorded acoustic environment.

In one implementation, the separated source signals can be filtered as per W-disjoint orthogonality (WDO) conditions. According to one definition, WDO assumes that the time-frequency representation of multiple sources do not overlap. In one implementation, the separated source signals are downmixed into one monophonic audio signal, which, along with side information, can be transmitted to the reproduction/decoder side. In one implementation, reproduction is possible using either headphones or an arbitrary loudspeaker configuration or any other means.

In one implementation, source counting and corresponding localization estimation may be performed by processing a mixture of signals/data received by a plurality of sensing devices, such as microphones arranged in an array, and by taking into account the known array geometry and/or correlation between signals from one or more pairs or other combinations of sensing devices in the array. As mentioned before, the sensing devices may be arranged in a circular array. In other embodiments, the devices may be arranged in an array having other configurations (e.g., triangle, square, straight or curved line or any other configuration). In one implementation, the SSC may partition the incoming signals/data from the sensing devices in overlapping time frames. The SSC may then apply joint-sparsifying transforms to the incoming signals in order to locate single-source analysis zones. In one implementation, each single-source analysis zone is a set of frequency adjacent time-frequency points. The SSC may assume that for each source there exists at least one single-source constant time analysis zones, interchangeably referred to as single-source analysis zone, where that source is dominant over others. The cross-correlation and/or auto-correlation of the moduli of time-frequency transforms of signals from various pairs of microphones are analyzed to identify single-source analysis zones based at least on a correlation coefficient/measure.

In some embodiments, a strongest frequency component of a cross-power spectrum of time-frequency signals from a pair of microphones may be used to estimate a DOA for each of the sources relative to a reference axis. This may be performed either simultaneously or in an orderly manner for each of the detected single-source analysis zones. In other embodiments, a selected number of frequency components may be used for DOA estimation. The estimated DOAs for each sound source may be clustered and the DOA density function may be obtained for each source over one or more portions of the signals. A smoothed histogram may be obtained by applying a filter having a window length $h_N$ and a predetermined number of frames. Additionally or alternatively, in one implementation, the number of sources may also be estimated from the histogram of DOA estimates, such as by using peak search or linear predictive coding. In some embodiments, the number of sources may be estimated from the histogram of DOA estimates using a matching pursuit technique. Additionally, refined and more accurate values of DOAs are generated corresponding to each of the estimated sources based at least on the histogram. While certain implementations may have been described to estimate the number of sources and their respective locations, it will be understood that other implementations are possible.

In some embodiments, the localization information relating to source locations and count may be specified by a user or obtained from a storage device. Some embodiments described herein allow for joint DOA estimation and source counting. The number of sources and directional information so obtained may be sent to the following processing stages. For example, the localization information from the DOA estimator and source counter may be used to separate source signals using spatial filtering methods and systems, such as at least one beamformer. In some embodiments, for example in cases where the number of sound sources is large (e.g., orchestra), the beamformer may scan the sound field at received locations. This may occur either based on locations specified by a DOA estimation module or by a user. In some embodiments, the beamformer may use both types of localization information, i.e., estimated and user-specified, in parallel and then combine the results in the end. In yet another embodiment, the beamformer may use a mix of localization information from the module and user, by identifying dominant directional sources and less directional or spatially-wide/extended sound sources, to yield beamformer output signals.

In some embodiments, SSC may include a post-filter to apply binary masks on the beamformer output signals to enhance the source signals. For example, in one implementation, source signals may be multiplied with corresponding orthogonal binary masks to yield estimated source signals.

Some embodiments include a downmixer or a reference signal generator to combine the estimated source signals into a single reference signal. The combination may be a logical summation or any other operation. Furthermore, weights may be added to certain signals. Further, side information may also be extracted. In one implementation, the side information includes the direction of arrival for each frequency bin. In one implementation, the side information and the time-domain downmix signal are sent to the decoder for reproduction. Both these types of information may be encoded. For example, the side information may be encoded based on the orthogonality of binary masks.

Some embodiments of the methods and systems described herein method consider only the spatial aliasing-free part of the spectrum to estimate the DOAs, so spatial aliasing does not affect the DOA estimates. Spatial aliasing may affect the beamformer performance, degrading source separation. However, as experimental results indicate, such degradation in source separation is unnoticeable to listeners. Moreover, since a different DOA for each time-frequency element is not estimated, the method does not suffer from erroneous estimates that may occur due to the weakened W-disjoint orthogonality (WDO) hypothesis when multiple sound sources are active. The listening test results show that this approach to modeling the acoustic environment is more effective than traditional array-based approaches. Moreover, based on the downmixing process, the separated source signals and thus the entire sound field are encoded into one monophonic signal and side information. During downmixing, the method assumes WDO conditions, but at this stage the WDO assumption does not affect the spatial impression and quality of the reconstructed sound field. One of the reasons is that compared to other methods, WDO conditions are not relied upon to extract the directional information of the sound field, but only to downmix the resulting separated source signals. Another important issue is that source separation through spatial filtering results in musical noise in the filtered signals, a problem which is evident in almost all blind source separation methods. However, in some embodiments, the separated signals are rendered simultaneously from different directions, which eliminates the musical distortion.

Some embodiments of the methods and systems described herein can offer lower computational complexity, higher sound quality, and higher accuracy as compared to existing solutions for spatial sound characterization, can operate in both real-time and offline modes (some implementations operate with less than or about 50% of the available processing time of a standard computer), and provide relaxed sparsity constraints on the source signals compared to conventional methods. Some embodiments of SSC are configured to operate regardless of the kind of sensing array, array topologies, number of sources and separations, SNR conditions, and environments, such as, for example, anechoic/reverberant, and/or simulated/real environments. In an embodiment, the sparse representation of the observation signals in time-frequency domain, along with source counting using matching pursuit based techniques on histogram of DOA estimates, and flexibility of running both the encoder and decoder stages in both in real-time and offline, can improve accuracy and robustness in adverse environments. Furthermore, the encoding and decoding of directional sound as described herein allows for a more natural reproduction of sound recording, thereby allowing recreation of the original scene as closely as possible. The spatial separation and reference signal generation helps reduce bitrate.

SSC may find various applications in the field, such as for teleconferencing, where knowledge of spatial sound can be used to create an immersive and more natural way of communication between two parties, or to enhance the capture of the desired speaker's voice, thus replacing lapel microphones. Other applications include, but are not limited to, gaming, entertainment systems, media rooms with surround sound capabilities, next-generation hearing aids, or any other applications which could benefit from providing a listener with a more realistic sensation of the environment by efficiently extracting, transmitting and reproducing spatial characteristics of a sound field.

Certain embodiments of SSC may be configured for use in standalone devices (e.g., PDAs, smartphones, laptops, PCs and/or the like). Other embodiments may be adapted for use in a first device (e.g., USB speakerphone, Bluetooth microphones, Wi-Fi microphones and/or the like), which may be connected to a second device (e.g., computers, PDAs, smartphones and/or the like) via any type of connection (e.g., Bluetooth, USB, Wi-Fi, serial, parallel, RF, infrared, optical and/or the like) to exchange various types of data (e.g., raw signals, processed data, recorded data and or signals and/or the like). In such embodiments, all or part of the data processing may happen on the first device, in other embodiments all or part of the data processing may happen on the second device. In some embodiments there maybe more than two devices connected and performing different functions and the connection between devices and processing may happen in stages at different times on different devices. Certain embodiments may be configured to work with various types of processors (e.g., ARM, Raspberry Pi and/or the like).

While aspects of the described SSC can be implemented in any number of different systems, circuitries, environments, and/or configurations, the embodiments are described in the context of the following exemplary system(s) and circuit(s). The descriptions and details of well-known components are omitted for simplicity of the description.

The description and figures merely illustrate exemplary embodiments of the SSC. It will thus be appreciated that those skilled in the art will be able to devise various arrangements that, although not explicitly described or shown herein, embody the principles of the present subject matter. Furthermore, all examples recited herein are intended to be for illustrative purposes only to aid the reader in understanding the principles of the present subject matter and the concepts contributed by the inventor(s) to furthering the art, and are to be construed as being without limitation to such specifically recited examples and conditions. Moreover, all statements herein reciting principles, aspects, and embodiments of the present subject matter, as well as specific examples thereof, are intended to encompass equivalents thereof.

The term "frequency component" is used to indicate one among a set of frequencies or frequency bands of a signal, such as a sample of a frequency domain representation of the signal (e.g., as produced by a fast Fourier transform) or a subband of the signal (e.g., a Bark scale or mel scale subband).

A method as described herein may be configured to process the captured signal as a series of short-time segments or time frames. Typical segment lengths range from about five or ten milliseconds to about forty or fifty milliseconds, and the segments may be overlapping (e.g., with adjacent segments overlapping by 25% or 50%) or non-overlapping. In one particular example, the signal is divided into a series of non-overlapping time segments or "frames", each having a length of ten milliseconds. A segment as processed by such a method may also be a segment (i.e., a "subframe") of a larger segment as processed by a different operation, or vice versa.

FIG. 1 illustrates an exemplary components of an SSC system 100 configured to receive sound signals from one or more P active sound sources, $s_1, s_2, \ldots s_p$, through a plurality of sound sensing devices, $m_1, m_2, \ldots m_M$, and process the signals to provide sound localization information, such as number of sound sources, direction of arrival of each source, and the like. Assuming a free-field model, a sound signal $x_M(t)$ received at each microphone $m_i$ can be modeled as:

$$x_m(t) = \sum_{p=1}^{P} h_{mp}(t) * s_p(t) \tag{1}$$

Where P is the number of sound sources, s(t) is the $p^{th}$ source signal, $h_{mp}(t)$ is the impulse response of the acoustic path from a source p to a sensor m, and * denotes the convolution operation. With the use of a time-frequency transform, such as the short-time Fourier transform (STFT), the model above can be expressed in the time-frequency domain as:

$$X_m(k, \omega) = \sum_{p=1}^{P} H_{mp}(k, \omega) S_p(k, \omega) \tag{2}$$

where k and w are the time frame and frequency indices, respectively, and $X_m(k, w)$, $H_{mp}(k, w)$, and $S_p(k, w)$ are the Fourier transforms of the signals $x_m(t)$, $h_{mp}(t)$, and $s_p(t)$, respectively.

If an anechoic model for the sound propagation is assumed and the room characteristics do not change over time, then the time dependency of the frequency response $H_{mp}$ can be omitted. Moreover, under the far-field assumption that the sound sources are distant enough, and the wavefronts impinging on the microphones are planar, the frequency response can be written as:

$$H_{mp}(\omega)=e^{j2\pi f_\omega \tau_m(\theta_p)} \quad (3)$$

where $\Sigma_m(\theta_p)$ is the time delay from source p to the $m^{th}$ microphone, $\theta_p$ is the DOA of source p with respect to a predefined microphone array coordinate system, and $f_\omega$ denotes the frequency in Hertz that corresponds to frequency index ω. It will be understood that even though a free-field model is described, the exemplary method and system can be configured to work robustly in simulated and/or real reverberant environments.

The processing of signals for determination of spatial sound characterization may include, but is not limited to, representing the received signals in a time-frequency domain; estimating DOAs of the active sources on a per time-frame basis; generating and/or smoothing of a histogram formed from a block of DOA estimates that can range from, in an example between 0.5 seconds to about 1 second; estimating the number of active sources and/or corresponding refined DOAs with one or more of source counting components, for example, a matching pursuit component, a peak-search component, or a linear predictive coding component; performing source separation based at least on the sound localization information; applying post-filtering on extracted source signals to remove interference; downmix the separated source signals into a reference signal; and package the reference and side information with or without additional encoding to reduce bitrate. The details of the exemplary systems and methods are described in subsequent paragraphs.

As described above, the system 100 includes a plurality of sound sensing devices labeled $m_1, m_2, \ldots m_M$, capable of detecting mechanical waves, such as sound signals, from one or more sound sources. In some embodiments, the devices may be microphones. Some embodiments may be configured to work with various types of microphones (e.g., dynamic, condenser, piezoelectric, MEMS and/or the like) and signals (e.g., analog and digital). The microphones may or may not be equispaced and the location of each microphone relative to a reference point and relative to each other may be known. Some embodiments may or may not comprise one or more sound sources, of which the position relative to the microphones may be known. Furthermore, the microphones may be arranged in the form of an array. The microphone array can be, for example, a linear array of microphones, a circular array of microphones, or an arbitrarily distributed coplanar array of microphones. The description hereinafter may relate to circular microphone arrays; however, similar methodologies can be implemented on other kind of microphone arrays.

Although mostly discussing audible sound waves, the SSC 100 may be configured to accommodate signals in the entire range of frequencies and may also accommodate signals in the entire range of frequencies and may also accommodate other types of signals (e.g., electromagnetic waves and/or the like).

The exemplary systems receive the signals captured by the plurality of sensing devices, and process received signals/data based at least on one or more parameters, such as array geometry, type of environments, and the like, to either estimate the number of the active sources, or their corresponding DOAs or both.

Each of the sound signals received by the microphones in the microphone array can include the sound signal from a sound source(s) located in proximity to the microphone or preferred spatial direction and frequency band among other unsuppressed sound signals from the disparate sound sources and directions, and ambient noise signals. In one implementation, the mixture of signals received at each of the microphones $m_1, m_2, \ldots m_M$ can be represented by $x_1(t)$, $x_2(t), \ldots, x_M(t)$, respectively. According to an implementation, each $x_i(t)$ can be represented by equation (1). The signals are received by a time-frequency (TF) transform module 102, which provides a time-frequency representation of the observations/received signals that can be represented as $X_1(k,\omega), X_2(k,\omega), \ldots X_M(k,\omega)$.

In an embodiment, the TF transform module 102 divides the received signals into time frames and then implements a short-term Fourier transform (STFT) as a sparsifying transform to partition the overall time-frequency spectrum into both time and frequency domains as a plurality of frequency bands ("slices") extending over a plurality of individual time slots ("slices") on which the Fourier transform is computed. Other sparsifying transforms may be employed in a similar manner. The frequency signals are transmitted to a DOA estimator and source counter 104.

In some embodiments, the DOA estimator and source counter 104 provides localization information, including but not limited to, an estimated number of sources and estimated directions of arrival. In one embodiment, the DOA estimator and source counter 104 receives localization information, directly or indirectly, from a user and temporarily or permanently stores such information as user-specified locations. In another embodiment, the DOA estimator and source counter 104 may use previously stored localization information. In one embodiment, the DOA estimator and source counter 104 provides localization information by detecting single-source analysis zones. In such an implementation, for each source, there is assumed to be at least one single-source analysis zone (SSAZ) where a single source is isolated, i.e., a zone where a single source is dominant over others. The sources can overlap in TF domain except in one or more of such SSAZs. Further, in one implementation, if several sources are active in the same SSAZ, they vary such that the moduli of at least two observations are linearly dependent. This allows processing of correlated sources, contrary to classical statistic-based DOA methods. In one implementation, the DOA estimator and source counter 104 detects one or more single-source analysis zones by determining cross-correlations and auto-correlations of the moduli of the time-frequency transforms of signals from pairs of sensing devices. In one implementation, correlation between all possible pairs of sensing devices are considered and the DOA estimator and source counter 104 can identify all zones for which a predetermined correlation coefficient condition is satisfied. In another implementation, average correlation between adjacent pairs of sensing devices is considered. Additionally or alternatively, the DOA estimator and source counter 104 can identify all zones for which the auto correlation coefficient is based on a system or user defined threshold. In yet another implementation, a desired combination of microphones may be used for calculation of correlation coefficient to detect SSAZs. In one example, such a selection can be made via a graphical user interface. In another example, the selection can be adaptively changed as per environment or system requirements. In one implementation, the detected SSAZs may be used by the DOA estimator and source counter 104 to derive the DOA estimates for each source in each of the detected SSAZs based at least on a cross-spectrum over all or selected few microphone pairs. Since the estimation of the DOA occurs in an SSAZ, the phasor of the cross-power spectrum of a microphone pair $\{m_i\ m_{i+1}\}$, or $\{m_i\ m_j\}$ as the case may be, is evaluated over a frequency range of the specific zone. In one implementation, the DOA estimator and source counter 104 then computes phase rotation factors and a circular integrated cross spectrum (CICS). Based on the CICS, the estimated DOA associated with a frequency component ω in the single-source analysis zone with frequency range Ω can be given by:

$$\hat{\theta}_\omega = \arg\max_{0\le\phi<2\pi} |CICS^{(\omega)}(\phi)| \tag{4}$$

In one implementation of the DOA estimator and source counter 104, a selected range or value(s) of ω are used for estimation of DOA in a single-source analysis zone. For example, in one implementation, $\omega_i^{max}$ frequency, which corresponds to the strongest component of the cross-power spectrum of the microphone pair $\{m_i\ m_{i+1}\}$ in a single source zone. By definition, $\omega_i^{max}$ is the frequency where the magnitude of cross-power spectrum reaches its maximum. In an example, $\omega_i^{max}$ gives a single DOA corresponding to each SSAZs.

In another implementation, d frequency components are used in each single-source analysis zone. For example, frequencies that correspond to the indices of the d highest peaks of the magnitude of the cross-power spectrum over all or selected microphone pairs $\{m_i\ m_j\}$ are used. The DOA estimator and source counter 104 thus yields d estimated DOAs from each SSAZ, thereby improving the accuracy of the system 100 as more frequency components lead to lower estimation error. The selection of d frequency components may be based on desired level of accuracy and performance and can be modified based on the real-time application where the system is implemented.

It will be understood that several single-source analysis zones may lead to the same DOA estimate, as the same isolated source may exists in all such zones. In one implementation, the DOA estimator and source counter 104 derives DOA for each source by clustering the estimated DOAs, which can be done by creating a histogram for a particular time segment; and then finding peaks in the histogram. In other implementations, DOAs and other such data-distribution can be represented in other ways, such as bar charts, etc.

Alternatively or additionally, once all the local DOAs have been estimated in each of the identified single-source analysis zones, the DOA estimator and source counter 104 creates a histogram from the set of estimations, for example in a block of B consecutive time frames. Any erroneous estimates of low cardinality, due to noise and/or reverberations only add a noise floor to the histogram. Further, in some embodiments, a smoothed histogram is obtained from the histogram. Additionally, a density function P(v) of the estimations is obtained by applying an averaging filter with a window, for example a rectangular window, of length $h_N$ over the estimations of the block. Therefore, if each bin of the smoothed histogram is denoted as v, the probability density function P(v) is given by:

$$P(v) = \frac{1}{N}\sum_{i=1}^{N}\frac{w}{h_N}\left(\frac{v-v_i}{h_N}\right),\ 0 \le v < 2\pi \tag{5}$$

where N is the total number of estimates in a block; $h_N$, is the length of the window, and w(.) is the rectangular window.

Alternatively, for a circular array of microphones, the cardinality y(v) can be given by:

$$y(v) = \sum_{i=1}^{N}\frac{w}{h_N}\left(\frac{v\times 360/L-\zeta_i}{h_N}\right),\ 0 \le v < L \tag{6}$$

Where L is the number of bins or frequency components in the histogram, $\zeta_i$ is the $i^{th}$ estimate (in degrees) out of N estimates in a block, and w(•) is the rectangular window of length $h_N$.

Given $y_N$, that is the length-L smoothed histogram in the $n^{th}$ frame, the DOA estimator and source counter 104 estimates the number of active sources $\hat{P}_N$ and their DOAs $\hat{\theta}_i$. In one implementation, the DOA $\hat{\theta}_i$ for each source can be estimated using:

$$\hat{\theta}_i = \frac{h_N N\sum_{j=ll}^{lh} j\cdot P(j)}{\sum_{j=ll}^{lh} P(j)} \quad \left\{\begin{matrix} ll = k - h_N/2 \\ lh = k + h_N/2 \end{matrix}\right\} \tag{7}$$

where i=1, . . . $\hat{P}_N$. The index k is one of the P highest local peaks of P(v) and there is 1 to 1 correspondence between i and k, N is the total number of estimates in a block $h_N$, is the length of the window, and w(.) is the rectangular window. In one example, the P highest local peaks are selected under the constraint that the peaks are "distant-enough", i.e., separated by a user defined threshold δ. In one implementation, the block of DOA estimates slides with each new time frame.

In other implementations, the DOA estimator and source counter 104 applies one or more methods that robustly estimate the number of active sources. To this end, the DOA estimator and source counter 104 may include at least one of a peak search module (not shown), a linear predictive coding (LPC) module (not shown), and/or a matching pursuit module (not shown) to count the number of active sources under the constraint that the maximum number of active sources may not exceed a user or system defined upper threshold $P_{max}$.

In one implementation, the peak search module, the LPC module, or a matching pursuit module can be implemented to estimate the number of sources. It will be understood for one source, one may get several DOAs from difference single-source analysis zones because of noisy estimation procedure while using cross-power spectrum over zones. But by using histogram, as per some embodiments, a more accurate value of DOA among all the estimates can be obtained. Furthermore, the estimation of DOAs does not happen per individual time-frequency element (or for each frequency bin) but for groups of frequencies which are found to be good candidates for the DOA estimation, i.e., those groups that will give robust estimation are selected. Once DOAs are obtained, each frequency bin may be assigned to one of these DOAs.

In said implementations, the DOA estimator and source counter 104 is capable of detecting all the sources, resulting in sufficiently accurate and smooth source trajectories. In the case of moving sources, some erroneous estimates may occur before and after the two sources meet and cross each other. However, since there are no active sources present in these directions, the subsequent operations, such as beamforming and post-filtering, are expected to cancel the reproduction of the signals from erroneous directions. Thus, as long as all the active sources are identified, individual erroneous estimates caused by an overestimation of the number of active sound sources cannot degrade the spatial audio reproduction.

In one embodiment, the output of the DOA estimator and source counter 104, such as the estimated number of sources $\hat{P}_k$ and a vector with the estimated DOA for each source $\theta_k=[\theta_1 \ldots \theta_{\hat{P}_k}]$ per time frame k, is transferred to a source separation unit 106. The source separation unit 106, in one implementation, may include for example, a beamformer, e.g., the fixed filter-sum superdirective beamformer. The frequency domain output of such a beamformer may be given by:

$$Y(\omega) = \sum_{m=1}^{M} w_m^*(\omega, \theta_s) X_m(\omega) \tag{8}$$

where $w_m(\omega,\theta_s)$ is a complex filter coefficient for the $m^{th}$ microphone to steer the beam to the desired steering direction $\theta_s$ and $(\bullet)^*$ denotes the complex conjugate operation. Superdirective beamformers aim to maximize the directivity factor or array gain, which measures the beamformer's ability to suppress spherically isotropic noise (diffuse noise). The array gain is defined as:

$$G_a(\omega) = \frac{|w(\omega, \theta_s)^H d(\omega, \theta_s)|^2}{w(\omega, \theta_s)^H \Gamma(\omega) w(\omega, \theta_s)} \tag{9}$$

where $w(\omega,\theta_s)=[w_1(\omega,\theta_s) \ldots w_M(\omega,\theta_s)]^T$ is the vector of filter coefficients for all sensors, $d(\omega,\theta_s)=[e^{-j2\pi f_\omega \tau_1(\theta_s)} \ldots e^{-2\pi f_\omega \tau_M(\theta_s)}]^T$ is the steering vector of the array, $\Gamma(\omega)$ is the M×M noise coherence matrix, $(\bullet)^T$ and $(\bullet)^H$ denote the transpose and the Hermitian transpose operation, respectively, and j is the imaginary unit. Under the assumption of a diffuse noise field, $\Gamma(\omega)$ can be modeled as:

$$\Gamma_{ij}(\omega) = B_0\left(\frac{2\pi f_\omega d_{ij}}{c}\right) \tag{10}$$

with being $B_0(\bullet)$ the zeroth-order Bessel function of the first kind, c is the speed of sound, and $d_{ij}$ the distance between microphones i and j, which in the case of a uniform circular array with radius r is given by:

$$d_{ij} = 2r\left|\sin\left(\frac{2\pi(i-j)}{2M}\right)\right| \tag{11}$$

In one implementation, the optimal filter coefficients for the superdirective beamformer can be found by maximizing $G_a(\omega)$, while maintaining a unit-gain constraint on the signal from the steering direction; that is, $$w(\omega,\theta_s)^H d(\omega,\theta_s)]=1 \tag{12}$$

In one implementation, a constraint is placed on the white noise gain (WNG), which expresses the beamformer's ability to suppress spatially white noise, since some beamformers are susceptible to extensive amplification of noise at low frequencies. The WNG is a measure of the beamformer's robustness and is defined as the array gain when $\Gamma(\omega)=I$, where I is the M×M identity matrix. Thus, the WNG constraint can be expressed as:

$$\frac{|w(\omega, \theta_s)^H d(\omega, \theta_s)|^2}{w(\omega, \theta_s)^H w(\omega, \theta_s)} \geq \gamma \tag{13}$$

where $\gamma$ represents the minimum desired WNG.

In one implementation, the optimal filters given the constraints of equations (12) and (13) are given by:

$$w(\omega, \theta_s) = \frac{[\varepsilon I + \Gamma(\omega)]^{-1} d(\omega, \theta_s)}{d(\omega, \theta_s)^H [\varepsilon I + \Gamma(\omega)]^{-1} d(\omega, \theta_s)}, \tag{14}$$

where the constant $\varepsilon$ is used to control the WNG constraint. WNG increases monotonically with increasing $\varepsilon$. However, there is a trade-off between robustness and spatial selectivity of the beamformer, as increasing the WNG decreases the directivity factor.

Figure 2B:
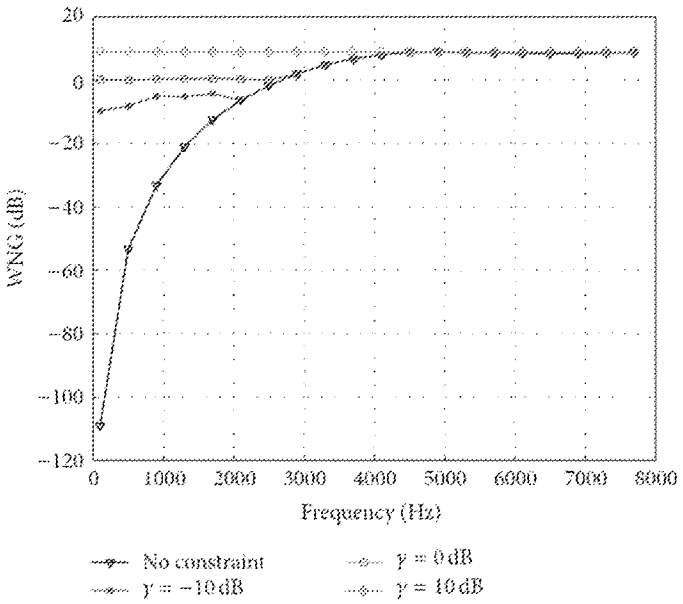
FIGS. 2A and 2B are exemplary plots indicating behavior of a beamformer, according to an embodiment of the present subject matter.
Figure 2A:
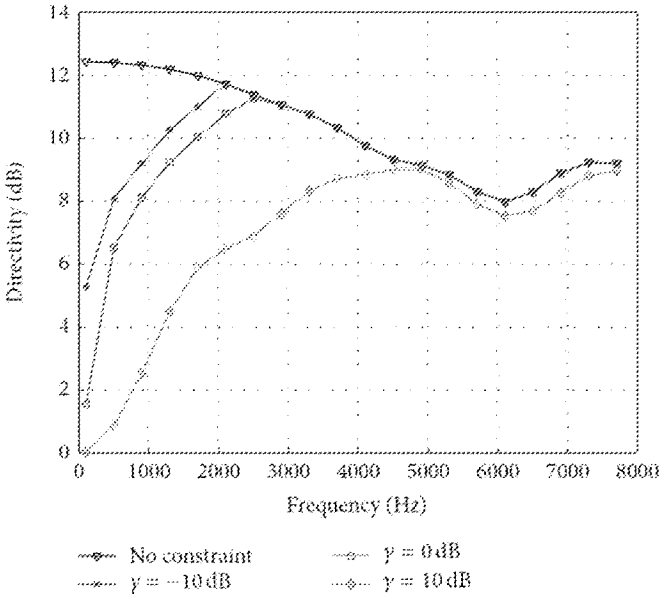

In one implementation, to calculate the beamformer filter coefficients, an iterative procedure may be used to determine $\varepsilon$ in a frequency-dependent manner. In one implementation, $\varepsilon$ is iteratively increased by a predetermined factor, say 0.005, starting from $\varepsilon=0$, until the WNG becomes equal or greater than $\gamma$. The resulting Directivity Factor and WNG for different values of, namely, $\gamma=-10$ dB, $\gamma=0$ dB, and $\gamma=10$ dB, are shown in FIGS. 2A and 2B, which also indicates the trade-off between WNG and directivity of the beamformer. The directivity factor and WNG when no constraint is applied to the WNG are also shown in FIGS. 2A and 2B. The results in FIGS. 2A and 2B have been calculated using a uniform circular array of 8 microphones and a radius of 0.05 m, for a steering direction of 90°, and $\gamma=-10$ dB. The beamformer maintains a good directivity pattern across frequencies. A directivity pattern (not shown) using the above data indicates that above the spatial-aliasing exists above the spatial aliasing cutoff frequency, which is 4 kHz for the specific array geometry. However, spatial aliasing in the beamforming process does not affect the spatial audio capturing and reproduction.

Some beamformers are signal independent and may therefore be computationally efficient to implement, since the filter coefficients for all steering directions need to be estimated only once and then stored offline. In one implementation, an adaptive version of a beamformer may be implemented in which the filter coefficients are estimated at run time.

In one implementation, in each time frame k, the beamforming process employs $\hat{P}_k$ concurrent beamformers. Each beamformer steers its beam to one of the directions specified by vector, $\theta_k$ yielding in total $\hat{P}_k$ signals $B_s(\omega)$, s=1, . . . $\hat{P}_k$ in the frequency domain, according to (8). In some embodiments, for example in cases where the number of sound sources is large (e.g., orchestra) or the sound sources are spatially wide, or far apart, the beamformer may scan the sound field at user-defined locations instead of real-time location estimates provided by a DOA estimation algorithm, to yield an equal number of beamformed signals. In some embodiments, the beamformer may use both types of localization information, i.e., user defined and localization estimates from another module, in parallel and then combine the results. In yet another embodiment, the beamformer may use a combination of localization information from the module and user, by identifying dominant directional sources and less directional or spatially-wide sound sources. In some other embodiments, the beamformer may completely eliminate the source counting and DOA estimation method and rely only on user-defined or previously stored location estimates and source count.

In one implementation, a post-filter 108 is implemented following the beamformer output. In one implementation, a post-filter 108 is applied to the beamformer output, for example to enhance the source signals and cause significant cancellation of interference from other directions. In one implementation, Wiener filters that are based on the auto and cross-power spectral densities between microphones are applied to the output of the beamformer. In another implementation, a post-filter configured for overlapped speech may be used to cancel interfering speakers from the target speakers' signals. During post-filtering the WDO assumption may be made, which also allows the separated source signals to be down-mixed into one audio signal. As per this implementation, it is assumed that in each time-frequency element there is only one dominant sound source (i.e., there is one source with significantly higher energy than the other sources). In speech signals this is a reasonable assumption, since the sparse and varying nature of speech makes it unlikely that two or more speakers will carry significant energy in the same time-frequency element (when the number of active speakers is relatively low). Moreover, it is known that the spectrogram of the additive combination of two or more speech signals is almost the same as the spectrogram formed by taking the maximum of the individual spectrograms in each time-frequency element.

Under this assumption, the post-filter constructs $\hat{P}_k$ binary masks as follows:

$$U_s(\omega) = \begin{cases} 1, \text{ if... } s = \underset{p}{\operatorname{argmax}} |B_P(\omega)|^2,\ p = 1, \ldots, \hat{P}_k \\ 0 \ldots \text{ otherwise.} \end{cases} \tag{15}$$

Equation (15) implies that for each frequency element, only the corresponding element from one of the beamformed signals is retained, that is, the one with the highest energy with respect to the other signals at that frequency element. It may be noted that even though the notation hereinafter may include (ω), however the entities continue to be in time-frequency domain unless specified otherwise. In some embodiments, the beamformer outputs are multiplied by their corresponding mask to yield the estimated source signals:

$$\hat{S}_s(\omega) = U_s(\omega) B_s(\omega),\ s = 1, \ldots, \hat{P}_k \tag{16}$$

In some embodiments, the post-filter can also be viewed as a classification procedure, as it assigns a time-frequency element to a specific source, based on the energy of the signals. Such masking allows keeping only the corresponding element of the source with the highest energy for each frequency element, while setting others to zero.

In some embodiments, the diffuse sound may be incorporated. In one implementation, the beamforming and post-filtering procedure can be realized across the whole spectrum of frequencies or up to a specific beamformer or a user-defined cutoff frequency. Processing only a certain range of the frequency spectrum may have several advantages, such as reduction in the computational complexity, especially when the sampling frequency is high, and reduction in the side information that needs to be transmitted, since DOA estimates are available only up to the beamformer cutoff frequency. Moreover, issues related to spatial aliasing may be avoided if the beamformer is applied only to the frequency range which is free from spatial aliasing. While the DOA estimation process does not suffer from spatial aliasing as it only considers frequencies below the spatial-aliasing cutoff frequency, the beamformer's performance may theoretically be degraded. There are spatial audio applications, that would tolerate this suboptimal approach. For example, a teleconferencing application, where the signal content is mostly speech and there is no need for very high audio quality, could tolerate using only the frequency spectrum up to 4 kHz (treating the rest of the spectrum as diffuse sound), without significant degradation in source spatialization.

For the frequencies above the beamformer or user-defined cutoff frequency, the spectrum from an arbitrary microphone may be included in the downmixed signal, without additional processing. As there are no DOA estimates available for this frequency range, it is treated as diffuse sound in the decoder and reproduced by all loudspeakers, in order to create a sense of immersion for the listener. However, extracting information from a limited frequency range can degrade the spatial impression of the sound. For this reason, including a diffuse part is optional. In another implementation, the beamformer cutoff frequency may be set to f/2; such that there is no diffuse sound.

The estimated source signals either with or without the incorporated diffuse sound are then received by a reference signal and side-information generator 110. In one implementation, the reference signal is based at least on the post-filtered source signals. In one implementation, only the non-diffuse part of the signals are used to form the reference signal. Additionally or alternatively, one or more of the original time-frequency signals may be used as reference. This is indicated by a dashed line. In other implementations, weights may be used for different post-filtered signals. In yet another implementation, certain post-filtered signals may be muted or ignored for reference signal generation.

According to one implementation, the post-filtered signals may be processed and/or combined into one signal, for example by summing the beamformed and post-filtered signals in the frequency domain to form a reference signal. The masks implemented by the post-filter are orthogonal with respect to each other This means that if $U_s(\omega)=1$ for some frequency index ω, then $U_{s'}(\omega)=0$ for $s' \neq s$, which is also the case for the signals $\hat{S}_s$. Using this property, the signals may be integrated to generate a reference signal indicative of the spatial characteristics of the sound field or part of the sound field desired by the user. In one implementation, the reference or dowmixed signal can be expressed as:

$$E(\omega) = \sum_{s=1}^{\hat{P}_k} \hat{S}_s(\omega) \tag{17}$$

together with the side information for each frequency element given by, $$I(\omega)=\theta_s, \text{ for the } s \text{ such that } \hat{S}_s(\omega)\neq 0 \quad (18)$$

As mentioned above, in other implementations, some other operators besides the sum operator, may be used with or without weights for generating the reference signal. In another implementation, background information of one or more signals may be used for reference.

In one implementation, the reference signal E(ω) is transformed back to the time domain as e(t) and is transmitted to the decoder, along with the side information as specified by (18). In one implementation, the signal e(t) can also be encoded as monophonic sound with the use of some coder (e.g., MP3, AAC, WMA, or any other audio coding format) in order to reduce bitrate. Furthermore, in one implementation, the side information may be encoded. For example, in one implementation, side information can be encoded based on binary masks, since the DOA estimate for each time-frequency element depends on the binary masks. The active sources at a given time frame are sorted in descending order according to the number of frequency bins assigned to them. The binary mask of the first (i.e., most dominant) source is inserted to the bit stream. Given the orthogonality property of the binary masks, the mask for the $s^{th}$ source at the frequency bins where at least one of the previous s−1 masks is one (since the rest of the masks will be zero) may or may not be encoded. These locations can be identified by a simple OR operation between the s−1 previous masks. Thus, for the second up to the $(\hat{P}_k-1)^{th}$ mask, only the locations where the previous masks are all zero are inserted to the bitstream. The mask of the last source may or may not be encoded, as it contains ones in the frequency bins that all the previous masks had zeros. In one implementation, a look-up table that associates the sources and/or masks with their DOAs is also included in the bitstream. In this implementation, the number of required bits does not increase linearly with the number of sources. On the contrary, for each next source lesser bits are used than the previous one. It is computationally efficient, since the main operations are simple OR and NOR operations. The resulted bitstream may be further compressed with Golomb entropy coding applied on the run-lengths of ones and zeros.

Figure 3A:
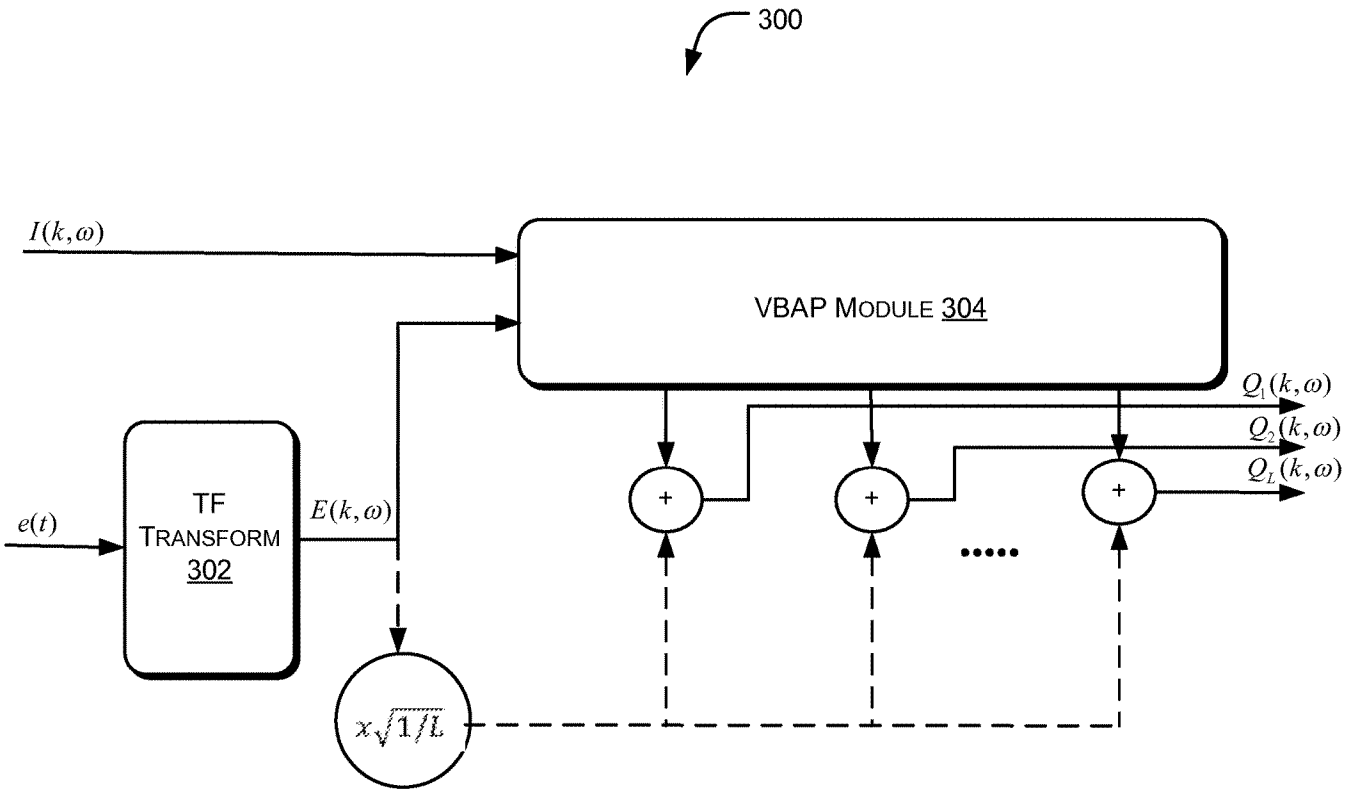
FIGS. 3A and 3B are exemplary block diagrams of an SSC decoder configured to reproduce captured spatial sound, according to an embodiment of the present subject matter.

FIG. 3A illustrates an exemplary decoder 300 according to an implementation of the present subject matter. In one implementation, the reference signal and side information are received at the decoder 300 or synthesis side for reproduction of spatial sound. Such information may or may not be encoded. The side information, if encoded, can be decoded in the following manner: the mask of the first source is retrieved first. For the mask of the $s^{th}$ source, the next n bits are read from the bitstream, where n is the number of frequencies that all the previous s−1 masks are zero. This can be identified by a simple NOR operation. For decoding the reference signal, a decoder compatible with the encoding scheme can be implemented.

Reproduction is possible using either headphones, an arbitrary loudspeaker configuration, or any other means. The reproduction of the multiple sources can include an interface where the listener can attenuate selected sources while enhancing others. Such selections may be based on estimated directions in the original sound field. Additionally, in some embodiments, the reproduction may include a mode where only one of the sources is reproduced, and all others are muted. In that case, in order to avoid musical noise, all other muted sources could be present in the background at a lower level compared to the main or non-muted sound signal so as to eliminate musical or any other type of noise.

For loudspeaker reproduction, the reference or downmixed signal and side information may be used in order to create spatial audio with an arbitrary loudspeaker setup. The non-diffuse and the diffuse parts (if the latter exists) of the spectrum are treated separately. First, the signal is divided into small overlapping time frames and transformed to the STFT domain using TF Transform Module 302, as in the analysis stage. The diffuse signal option corresponds to the dashed line in FIG. 3A.

In one implementation, the non-diffuse part of the spectrum is synthesized for example, using amplitude panning, such as vector-base amplitude panning (VBAP) module 304 at each frequency index, according to its corresponding DOA from I(w). Even though the description is based on VBAP panning, it will be understood that other kinds of amplitude panning or methods or reproducing spatial sound may be used. By adjusting the gains of a set of loudspeakers, VBAP module 304 positions a sound source anywhere across an arc defined by two adjacent loudspeakers, in a 2-dimensional case or inside a triangle defined by three loudspeakers in the 3-dimensional case. If a diffuse part is included, then it is simultaneously played back from all loudspeakers.

Assuming a loudspeaker configuration with L loudspeakers, the $l^{th}$ loudspeaker signal is given by:

$$Q_l(\omega)=\begin{cases} g_l(\omega)E(\omega) \ \ldots \text{ for } \omega \leq \omega_{cutoff} \\ \frac{1}{\sqrt{L}}E(\omega) \text{ for } \omega > \omega_{cutoff} \end{cases} \quad (19)$$

where $\omega_{cutoff}$ is the beamformer cutoff frequency index, $g_l(\omega)$ is the gain for the $l^{th}$ loudspeaker at frequency index ω, as computed from VBAP module 304, and the diffuse part is divided by the square root of the number of loudspeakers to preserve the total energy. If $\omega_{cutoff}=f_s/2$, then the full spectrum processing method is applied and no diffuse part is included.

Figure 3B:
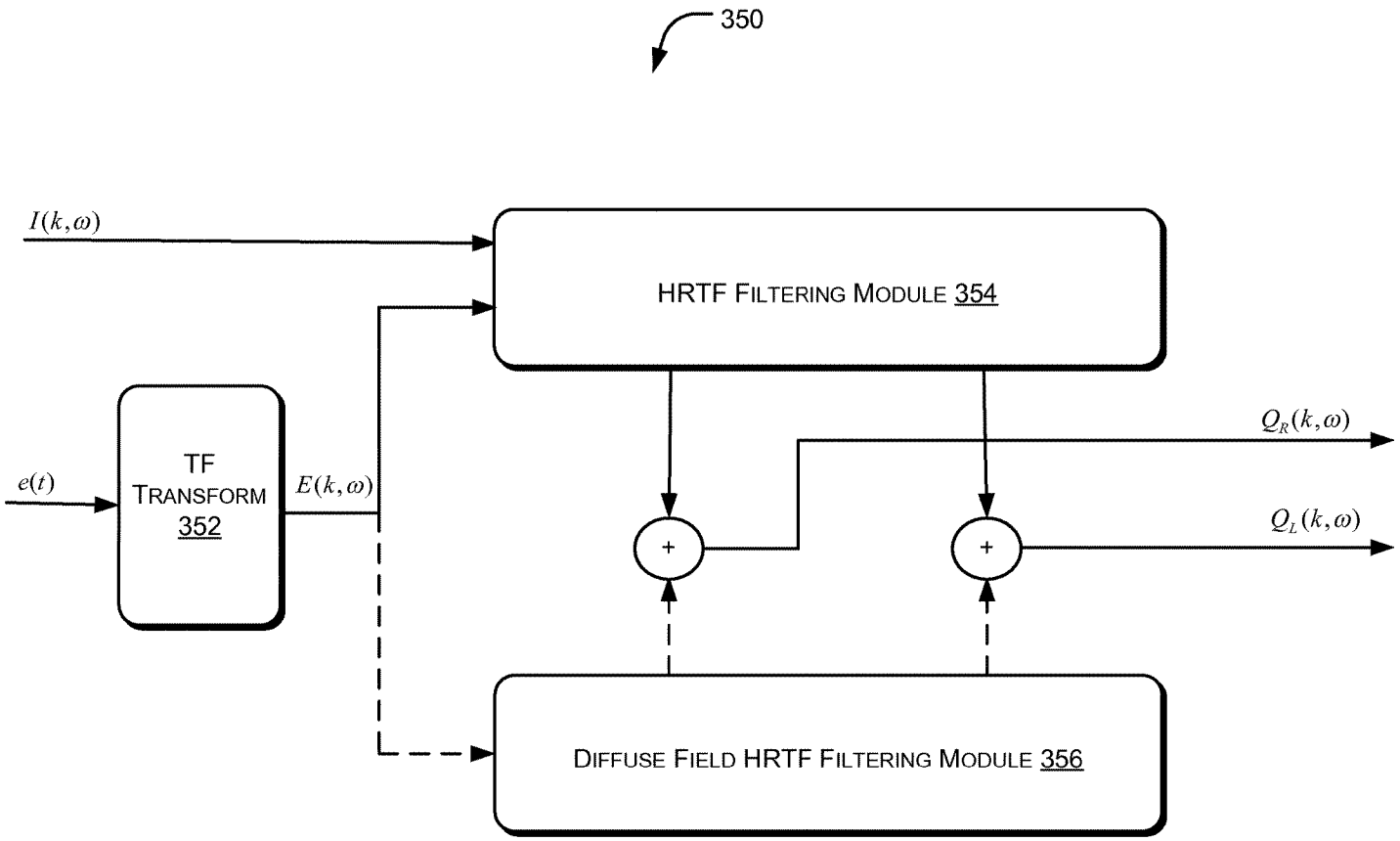

FIG. 3B illustrates an exemplary decoder 300 according to an implementation of the present subject matter. In one implementation, for Binaural Reproduction, head-related transfer functions (HRTFs) may be implemented in order to position each source in a certain direction. To this end, the reference signal and side information are received at the decoder 300 or synthesis side for reproduction of spatial sound. Such information may or may not be encoded. As mentioned in FIG. 3A, the side information and the reference signal can be separately encoded based on the encoding scheme. The non-diffuse and the diffuse parts (if the latter exists) of the spectrum are again treated separately. First, the signal is divided into small overlapping time frames and transformed to the STFT domain using TF Transform Module 352. The diffuse signal option corresponds to the dashed line in FIG. 3B.

According to one implementation, after transforming the downmixed or reference signal e(t) into the STFT domain, the non-diffuse part is filtered in each time-frequency element with the HRTF using HRTF Filtering Module 354, based at least on the side information available in I(w). Thus, the left and right output channels for the non-diffuse part, at a given time frame, are produced by:

$$Y_L(\omega)=E(\omega)HRTF_L(\omega,I(\omega)),\ \omega\leq\omega_{cutoff}$$

$$Y_R(\omega)=E(\omega)HRTF_R(\omega,I(\omega)),\ \omega\leq\omega_{cutoff} \quad (20)$$

where $HRTF_{\{L,R\}}$ is the head-related transfer function for the left or right channel, as a function of frequency and direction, and $Y_L/Q_L$ and $Y_R/Q_R$ are signals from both the left and right channels, respectively.

In one implementation, the diffuse part is filtered with a diffuse field HRTF filtering module 356, in order to make its magnitude response similar to the non-diffuse part. In one implementation, diffuse field HRTFs can be produced by averaging HRTFs from different directions across the whole circle around the listener. The filtering process in this case becomes the following:

$$Y_L(\omega)=E(\omega)HRTF_L^{diff}(\omega),\ \omega>\omega_{cutoff}$$

$$Y_R(\omega)=E(\omega)HRTF_R^{diff}(\omega),\ \omega>\omega_{cutoff} \quad (21)$$

Figure 4:
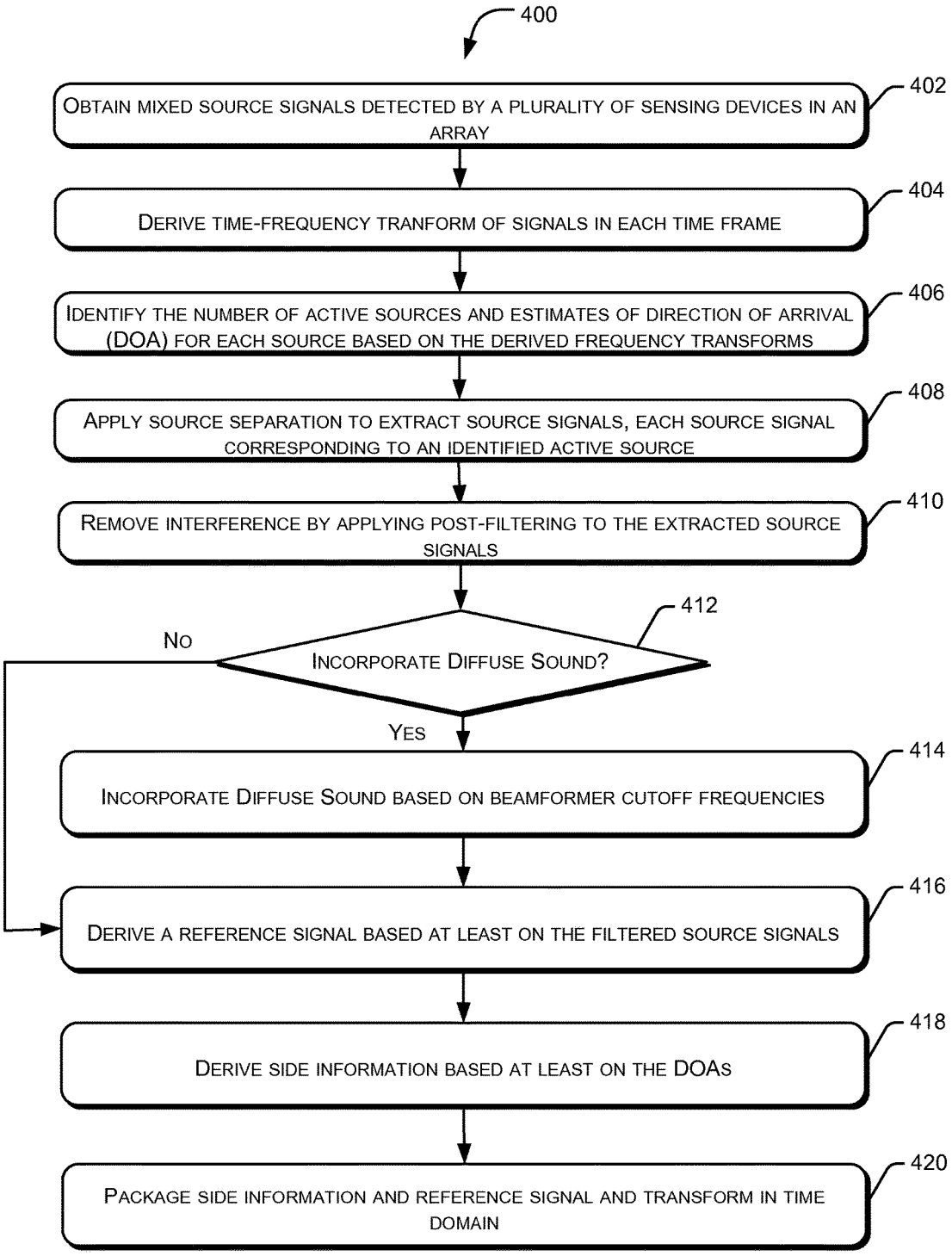
FIG. 4 is an exemplary method for encoding spatial sound, according to an embodiment of the present subject matter.
Figure 5:
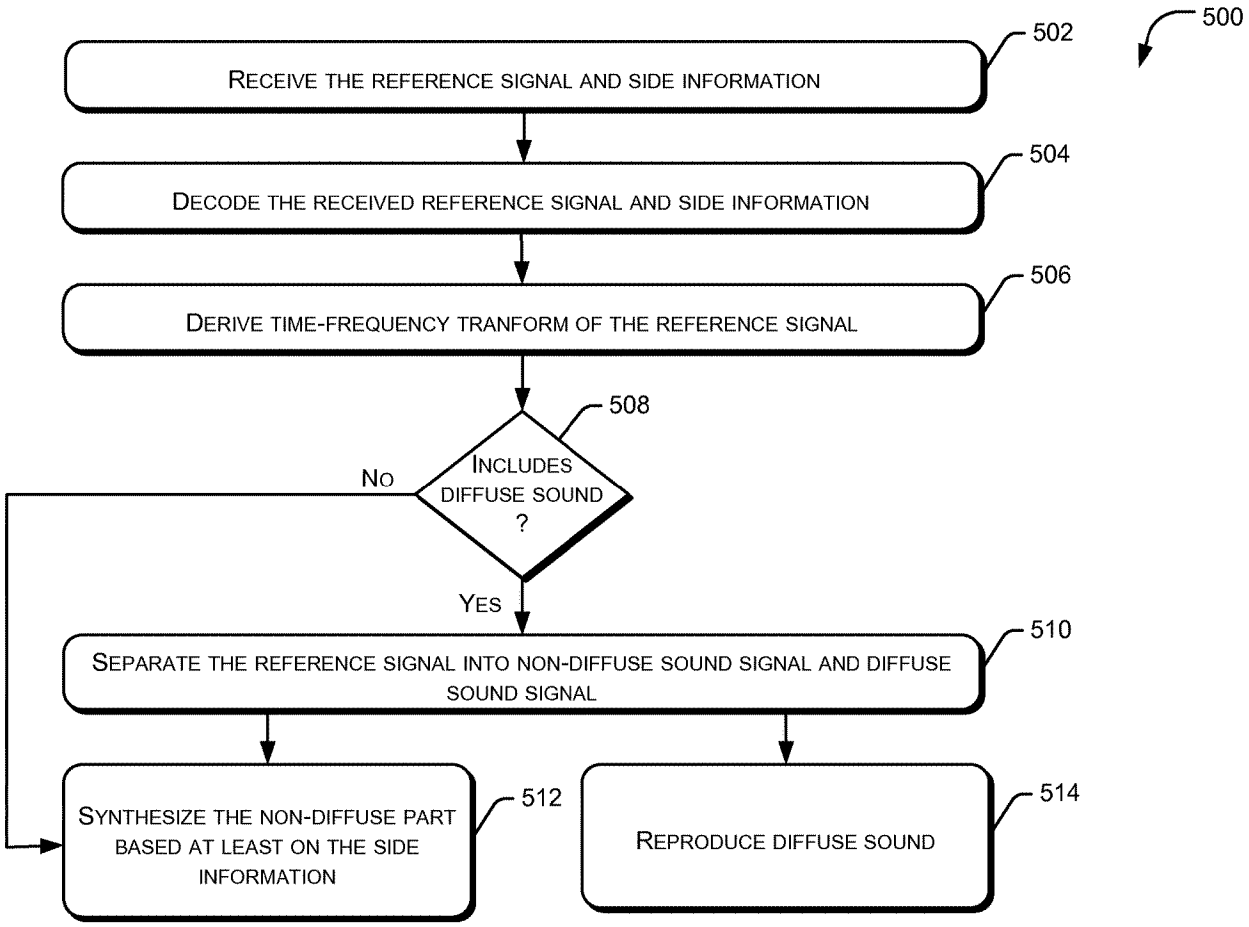
FIG. 5 is an exemplary method to reproduce spatial sound, according to an embodiment of the present subject matter.

FIG. 4 illustrates an exemplary method 400 for spatial sound characterization, according to an exemplary embodiment of the present subject matter. FIG. 5 illustrates method 500 for reproduction of spatial sound on the decoder side, according to an exemplary embodiment of the present subject matter. The order in which both the methods are described are not intended to be construed as a limitation, and any number of the described method blocks can be combined in any order to implement the methods, or an alternative method. Additionally, individual blocks may be deleted from the methods without departing from the spirit and scope of the subject matter described herein. Furthermore, the methods can be implemented in any suitable hardware, software, firmware, or combination thereof.

The exemplary methods may be described in the general context of computer executable instructions. Generally, computer executable instructions can include routines, programs, objects, components, data structures, procedures, modules, functions, etc., that perform particular functions or implement particular abstract data types. The methods may also be practiced in a distributed computing environment where functions are performed by remote processing devices that are linked through a communications network. In a distributed computing environment, computer executable instructions may be located in both local and remote computer storage media, including memory storage devices.

At block 402, mixed source signals, detected by a plurality of sensing devices in an array, are obtained. In one implementation, mixed source signals from one or more sources, such as sound sources, are detected by a plurality of sensing devices, such as microphones. For example, the mixed source signals include signals from the source in proximity to the microphone and unsuppressed signals from other sources, such as adjacent sources, and ambient noise signals. The microphones may be arranged in any known configuration, such as circular, linear, etc.

At block 404, time-frequency transform of each of the received mixed source signal is obtained. In one implementation, the received mixed source signals are segmented into a plurality of overlapping time frames on which sparsifying transform, such as STFT, is implemented.

At block 406, the estimated number of active sources $\hat{P}_k$ and their DOAs are obtained or identified based at least on the derived frequency transformations of mixed source signals. In one implementation, the localization information is specified by a user or obtained from a storage device. In another implementation, the following method is used to estimate the DOAs in real time and with high accuracy in reverberant environments for multiple simultaneously active sources. The method includes detection of single-source analysis zones in the time-frequency domain. The single-source analysis zones, in one implementation, are a time-frequency windows or zones in which one source is dominant over others. And if several sources are active in the same zone, the assumption is that the signals from the two sources vary so that the moduli of at least two observations are linearly dependent. This allows processing of correlated sources, contrary to classical statistic-based DOA methods. In one implementation, the single-source analysis zones are detected based at least on correlation coefficients/confidence measures. In one implementation, the correlation coefficients can be obtained using cross-correlations and auto-correlations between signals from pairs of sensing devices. The zones that do not meet predefined criteria are discarded. In one implementation, DOA estimates may be based on d frequency components in each single-source analysis zone, i.e., the use of those frequencies that correspond to the indices of the d highest peaks of the magnitude of the cross-power spectrum over all or selected number of sensing devices. In another example, the DOA estimates may be based on the strongest frequency component of the cross-power spectrum of the pair of sensing devices in a single-source analysis zone, giving us a single DOA for each single-source analysis zone. The number of DOA estimates per SSAZ may be based on a desired level of accuracy and computational efficiency. Further, in one implementation, several single-source analysis zones may lead to the same DOA as the isolated source is the same in each of them. Deriving the DOA for each sound source involves clustering the estimated DOAs, which can be done by first forming a histogram from the set of estimations in a block of B consecutive frames and then by finding peaks in their histogram for the particular time frame. In one implementation, a smoothed histogram can be obtained by applying Parzen windows, or an average filter with a window of length $h_N$. In other implementations, density function, such as probability density function v, of the estimated DOAs in each of the single-source analysis zones can be obtained. The density functions v can then be used to cluster one or more estimated DOAs and generate source-specific DOAs. In one implementation, the number of active sources $\hat{P}_k$ and their DOAs are estimated from the smoothed histogram. One of the source counting modules from amongst peak search module, LPC module, or matching pursuit module may be selected and the sound sources are counted based at least on the combined DOA using the selected counting module. Other statistical methods for counting sources and/or detecting peaks are contemplated by the present subject matter.

In one implementation, the estimated number of active sources and corresponding refined DOA estimates for each source (with 1 degree resolution) per time frame can be displayed on a user interface in one or more formats, such as graphs, tables, etc., or transmitted in real-time a input to a following stage as described in subsequent paragraphs.

At block 408, mixed source signals are separated, such that each mixed source signal corresponds to an identified active source. In one implementation, such spatial separation is performed using beamformers, for example fixed filter-sum superdirective beamformers. In one implementation, the beamforming process employs $\hat{P}_k$ concurrent beamformers each of them steering its beam to one of the directions in $\theta_k$, resulting in the beamformed signals $B_s(k,\omega)$, s=1, . . . , $\hat{P}_k$, with ω being the frequency index. In one embodiment, the beamformer filter coefficients are calculated by maximizing the array gain, while maintaining a minimum constraint on the white noise gain. Beamformers, such as fixed beamformers, are signal-independent, so they are computationally efficient to implement, facilitating their use in real-time systems, since the filter coefficients for all directions can be estimated offline. Even though the description may be described with the example of Fixed beamformers, other beamformers and other means of spatial separation may be used as will be understood by a person skilled in the art.

At block 410, post-filtering is applied to the extracted source signals. In one implementation, a post-filter is applied to the beamformer output, for example to enhance the source signals and cause significant cancellation of interference from other directions. In one implementation, Wiener filters that are based on the auto and cross-power spectral densities between microphones are applied to the output of the beamformer. In another implementation, a post-filter configured for overlapped speech may be used to cancel interfering speakers from the target speakers' signals. During post-filtering the WDO assumption may be made, which also allows the separated source signals to be down-mixed into one audio signal. As per this implementation, the post-filter constructs $\hat{P}_k$ binary masks. Thus, for each frequency element, only the corresponding element from one of the beamformed signals is retained, that is, the one with the highest energy with respect to the other signals at that frequency element. The beamformer outputs are multiplied by their corresponding mask to yield the estimated source signals $\hat{S}_s(k,\omega)$, s=1, . . . , $\hat{P}_k$. In said implementation, masking allows keeping only the corresponding element of the source with the highest energy for each frequency element, while setting others to zero.

At block 412, a determination is made to incorporate diffuse sound. In one implementation, if it is determined that the no diffuse sound needs to be added ("No" at block 412), the control transitions to block 416. However, if it is determined that diffuse sound is to be incorporated ("Yes" at block 412), the control transitions to block 414.

At block 414, diffuse sound is incorporated. to the beamforming and post-filtering procedure can be applied to the whole spectrum or up to a specific beamformer or user-specified cutoff frequency. For the frequencies above the cutoff frequency, the spectrum from an arbitrary microphone is included in the reference signal, without additional processing. As there are no DOA estimates available for this frequency range, it is treated as diffuse sound in the decoder and reproduced by all loudspeakers.

At block 416, a reference signal is derived. In one implementation, the reference signal is based at least on the post-filtered mixed source signals. Since, the masks at block 410 are orthogonal with respect to each other. This means that if $U_s(\omega)=1$ for some frequency index $\omega$, then $U_s(\omega)=0$ for $s'\neq s$, which is also the case for the signals $\hat{S}_s$. Using this property, the signals may be processed into one signal, for example by summing them up in the frequency domain to form a reference signal.

At block 418, side information is derived based at least on the DOAs. In one implementation, side information for each time-frequency element or frequency bin may be based on DOAs selected by the beamforming and filtering modules.

At block 420, the encoded side information and reference signal is packaged and transformed into time domain, e(t). In one implementation, the reference signal e(t) is transformed in time domain and encoded as monophonic sound with the use of some coder (e.g., MP3, AAC, WMA, etc.) in order to reduce bitrate. In one implementation, the side-information may also be separately encoded. Furthermore, since the DOA estimate for each time-frequency element depends on the binary masks of Equation (15), the masks and in turn side information can be encoded. The active sources at a given time frame are sorted in descending order according to the number of frequency bins assigned to them. The binary mask of the first (i.e., most dominant) source is inserted to the bit stream. Given the orthogonality property of the binary masks, the mask for the $s^{th}$ source at the frequency bins where at least one of the previous s−1 masks is one (since the rest of the masks will be zero) may or may not be encoded. These locations can be identified by a simple OR operation between the s−1 previous masks. Thus, for the second up to the $(\hat{P}_k-1)^{th}$ mask, only the locations where the previous masks are all zero are inserted to the bitstream. The mask of the last source may or may not be encoded, as it contains ones in the frequency bins that all the previous masks had zeros. In one implementation, a look-up table that associates the sources with their DOAs is also included in the bitstream. In this implementation, the number of required bits does not increase linearly with the number of sources. On the contrary, for each next source lesser bits are used than the previous one. It is computationally efficient, since the main operations are simple OR and NOR operations. The resulted bitstream may be further compressed with Golomb entropy coding applied on the run-lengths of ones and zeros. Such an encoded bitstream is then packaged with an encoded reference signal and sent to the decoder or saved on a storage device for processing in future.

In another implementation, the reference signal is transformed back to the time domain and is transmitted to the decoder without any encoding, along with side information as specified by equation 18.

Referring to FIG. 5, decoding of the side information and reference signal is described. At block 502, the reference signal and side information is received from the encoder side. In the synthesis stage, the reference signal and side information are used in order to create spatial audio with an arbitrary loudspeaker setup or headphones as the case may be.

At block 504, the encoded reference signal and side information are encoded by means described in block 420 of FIG. 4, or by any other means, are decoded. For example, in the case the reference signal is encoded with MP3, an MP3 decoder is applied. Accordingly, based on the scheme of decoding used at the encoder side, a compatible decoder is implemented on the decoder side for decoding the reference signal.

For decoding the side information, the mask of the first source is retrieved. For the mask of the $s^{th}$ source, the next n bits are read from the bitstream, where n is the number of frequencies that all the previous s−1 masks are zero. This can be identified by a simple NOR operation. In other implementations, other schemes of decoding side information may be used.

At block 506, the time frequency transform of the reference signal is derived. In one implementation, the reference signal is divided into small overlapping time frames and transformed to the STFT domain, as in the analysis stage.

At block 508, it is determined whether the diffuse sound signal is included and needs to be processed. In one implementation, if it is determined that the no diffuse sound is included ("No" at block 508), the control transitions to block 512. However, if it is determined that diffuse sound is included ("Yes" at block 508), the control transitions to block 510.

At block 510, spectrum of the reference signal is separated into non-diffuse and diffuse part based on, for example the beamformer or user-defined cut-off frequencies.

At block 512, the non-diffuse sound signal is generated using one of many techniques such as amplitude panning or head-related transfer function (HRTF), or any other techniques. In one implementation, for reproduction using an arbitrary number of loudspeakers, amplitude panning may be implemented. For example, the non-diffuse part may be synthesized using Vector-Base Amplitude Panning (VBAP) at each frequency element. If a diffuse part is included, in one implementation, it is played back from all loudspeakers after scaling by the reciprocal of the square root of the number of loudspeakers to preserve the total energy, at block 514. For headphone reproduction, each frequency element of the non-diffuse part can be filtered with the left and right Head-Related Transfer Functions (HRTFs), according to the DOA assigned to the respective frequency element. The diffuse part (if it exists) can be included in both left and right channels by implementing diffuse field HRTF filtering to the reference signal in block 514.

SSC Controller

Figure 6:
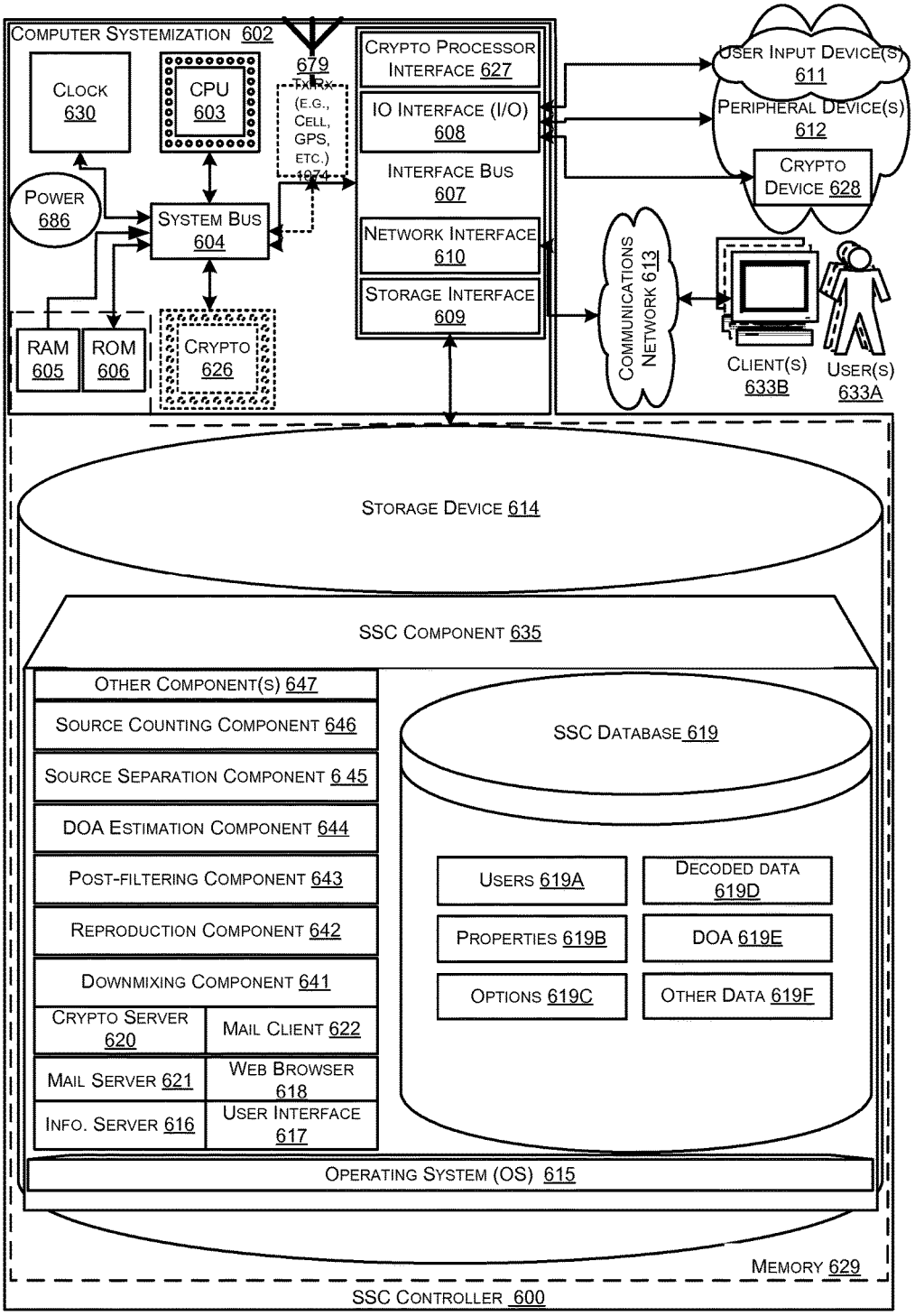
FIG. 6 is a block diagram of an SSC controller, according to an embodiment of the present subject matter.

FIG. 6 shows a block diagram illustrating exemplary embodiments of an SSC controller 600. In this embodiment, the SSC controller 6006 may serve to aggregate, process, store, search, serve, identify, instruct, generate, match, and/or facilitate interactions with a computer through technologies, and/or other related data.

Users, e.g., 633A, which may be people and/or other systems, may engage information technology systems (e.g., computers) to facilitate information processing. In turn, computers employ processors to process information; such processors 1003 may be referred to as central processing units (CPU). One form of processor is referred to as a microprocessor. CPUs use communicative circuits to pass binary encoded signals acting as instructions to enable various operations. These instructions may be operational and/or data instructions containing and/or referencing other instructions and data in various processor accessible and operable areas of memory 629 (e.g., registers, cache memory, random access memory, etc.). Such communicative instructions may be stored and/or transmitted in batches (e.g., batches of instructions) as programs and/or data components to facilitate desired operations. These stored instruction codes, e.g., programs, may engage the CPU circuit components and other motherboard and/or system components to perform desired operations. One type of program is a computer operating system, which, may be executed by the CPU on a computer; the operating system enables and facilitates users to access and operate computer information technology and resources. Some resources that may be employed in information technology systems include: input and output mechanisms through which data may pass into and out of a computer; memory storage into which data may be saved; and processors by which information may be processed. These information technology systems may be used to collect data for later retrieval, analysis, and manipulation, which may be facilitated through a database program. These information technology systems provide interfaces that allow users to access and operate various system components.

In one embodiment, the SSC controller 600 may be connected to and/or communicate with entities such as, but not limited to: one or more users from user input devices 611; peripheral devices 612; an optional cryptographic processor device 628; and/or a communications network 613 (hereinafter referred to as networks).

Networks 613 are understood to comprise the interconnection and interoperation of clients, servers, and intermediary nodes in a graph topology. It should be noted that the term "server" as used throughout this application refers generally to a computer, other device, program, or combination thereof that processes and responds to the requests of remote users across a communications network. Servers serve their information to requesting "clients." A computer, other device, program, or combination thereof that facilitates, processes information and requests, and/or furthers the passage of information from a source user to a destination user is commonly referred to as a "node." Networks are generally thought to facilitate the transfer of information from source points to destinations. A node specifically tasked with furthering the passage of information from a source to a destination is commonly called a "router." There are many forms of networks such as Local Area Networks (LANs), Pico networks, Wide Area Networks (WANs), Wireless Networks (WLANs), etc. For example, the Internet is generally accepted as being an interconnection of a multitude of networks whereby remote clients and servers may access and interoperate with one another.

The SSC controller 600 may be based on computer systems that may comprise, but are not limited to, components such as: a computer systemization 602 connected to memory 629.

Computer Systemization

A computer systemization 602 may comprise a clock 630, central processing unit ("CPU(s)" and/or "processor(s)" (these terms are used interchangeable throughout the disclosure unless noted to the contrary)) 603, a memory 629 (e.g., a read only memory (ROM) 606, a random access memory (RAM) 605, etc.), and/or an interface bus 607, and most frequently, although not necessarily, are all interconnected and/or communicating through a system bus 604 on one or more (mother)board(s) having conductive and/or otherwise transportive circuit pathways through which instructions (e.g., binary encoded signals) may travel to effectuate communications, operations, storage, etc. The computer systemization may be connected to a power source 686; e.g., optionally the power source may be internal. Optionally, a cryptographic processor 626 and/or transceivers (e.g., ICs) 674 may be connected to the system bus. In another embodiment, the cryptographic processor and/or transceivers may be connected as either internal and/or external peripheral devices 612 via the interface bus I/O. In turn, the transceivers may be connected to antenna(s) 679, thereby effectuating wireless transmission and reception of various communication and/or sensor protocols; for example the antenna(s) may connect to: a Texas Instruments WiLink WL5283 transceiver chip (e.g., providing 802.11n, Bluetooth 3.0, FM, global positioning system (GPS) (thereby allowing SSC controller 200 to determine its location)); Broadcom BCM4329FKUBG transceiver chip (e.g., providing 802.11n, Bluetooth 2.1+EDR, FM, etc.); a Broadcom BCM4750IUB8 receiver chip (e.g., GPS); an Infineon Technologies X-Gold 618-PMB9800 (e.g., providing 2G/3G HSDPA/HSUPA communications); and/or the like. The system clock typically has a crystal oscillator and generates a base signal through the computer systemization's circuit pathways. The clock is typically coupled to the system bus and various clock multipliers that may increase or decrease the base operating frequency for other components interconnected in the computer systemization. The clock and various components in a computer systemization drive signals embodying information throughout the system. Such transmission and reception of instructions embodying information throughout a computer systemization may be commonly referred to as communications. These communicative instructions may further be transmitted, received, and the cause of return and/or reply communications beyond the instant computer systemization to: communications networks, input devices, other computer systemizations, peripheral devices, and/or the like. It should be understood that in alternative embodiments, any of the above components may be connected directly to one another, connected to the CPU, and/or organized in numerous variations employed as exemplified by various computer systems.

The CPU comprises at least one high-speed data processor adequate to execute program components for executing user and/or system-generated requests. Often, the processors themselves may incorporate various specialized processing units, such as, but not limited to: integrated system (bus) controllers, memory management control units, floating point units, and even specialized processing sub-units like graphics processing units, digital signal processing units, and/or the like. Additionally, processors may include internal fast access addressable memory, and be capable of mapping and addressing memory 529 beyond the processor itself; internal memory may include, but is not limited to: fast registers, various levels of cache memory (e.g., level 1, 2, 3, etc.), RAM, etc. The processor may access this memory through the use of a memory address space that is accessible via instruction address, which the processor can construct and decode allowing it to access a circuit path to a specific memory address space having a memory state. The CPU may be a microprocessor such as: AMD's Athlon, Duron and/or Opteron; ARM's application, embedded and secure processors; IBM and/or Motorola's DragonBall and PowerPC; IBM's and Sony's Cell processor; Intel's Celeron, Core (2) Duo, Itanium, Pentium, Xeon, and/or XScale; and/or the like processor(s). The CPU interacts with memory through instruction passing through conductive and/or transportive conduits (e.g., (printed) electronic and/or optic circuits) to execute stored instructions (i.e., program code) according to conventional data processing techniques. Such instruction passing facilitates communication within the SSC controller and beyond through various interfaces. Should processing requirements dictate a greater amount of speed and/or capacity, distributed processors (e.g., Distributed SSC system), mainframe, multi-core, parallel, and/or super-computer architectures may similarly be employed. Alternatively, should deployment requirements dictate greater portability, smaller Personal Digital Assistants (PDAs) may be employed.

Depending on the particular implementation, features of the SSC system may be achieved by implementing a microcontroller such as CAST's R8051XC2 microcontroller; Intel's MCS 51 (i.e., 8051 microcontroller); and/or the like. Also, to implement certain features of the SSC system, some feature implementations may rely on embedded components, such as: Application-Specific Integrated Circuit ("ASIC"), Digital Signal Processing ("DSP"), Field Programmable Gate Array ("FPGA"), and/or the like embedded technology. For example, any of the SSC system component collection (distributed or otherwise) and/or features may be implemented via the microprocessor and/or via embedded components; e.g., via ASIC, coprocessor, DSP, FPGA, and/or the like. Alternately, some implementations of the SSC system may be implemented with embedded components that are configured and used to achieve a variety of features or signal processing.

Depending on the particular implementation, the embedded components may include software solutions, hardware solutions, and/or some combination of both hardware/software solutions. For example, SSC system features discussed herein may be achieved through implementing FPGAs, which are a semiconductor devices containing programmable logic components called "logic blocks", and programmable interconnects, such as the high performance FPGA Virtex series and/or the low cost Spartan series manufactured by Xilinx. Logic blocks and interconnects can be programmed by the customer or designer, after the FPGA is manufactured, to implement any of SSC system features. A hierarchy of programmable interconnects allow logic blocks to be interconnected as needed by the SSC system designer/administrator, somewhat like a one-chip programmable breadboard. An FPGA's logic blocks can be programmed to perform the operation of basic logic gates such as AND, and XOR, or more complex combinational operators such as decoders or mathematical operations. In most FPGAs, the logic blocks also include memory elements, which may be circuit flip-flops or more complete blocks of memory. In some circumstances, the SSC system may be developed on regular FPGAs and then migrated into a fixed version that more resembles ASIC implementations. Alternate or coordinating implementations may migrate SSC controller 500 features to a final ASIC instead of or in addition to FPGAs. Depending on the implementation all of the aforementioned embedded components and microprocessors may be considered the "CPU" and/or "processor" for the SSC system.

Power Source

The power source 686 may be of any standard form for powering small electronic circuit board devices such as the following power cells: alkaline, lithium hydride, lithium ion, lithium polymer, nickel cadmium, solar cells, and/or the like. Other types of AC or DC power sources may be used as well. In the case of solar cells, in one embodiment, the case provides an aperture through which the solar cell may capture photonic energy. The power cell 686 is connected to at least one of the interconnected subsequent components of the SSC system thereby providing an electric current to all subsequent components. In one example, the power source 686 is connected to the system bus component 604. In an alternative embodiment, an outside power source 686 is provided through a connection across the I/O 608 interface. For example, a USB and/or IEEE 1394 connection carries both data and power across the connection and is therefore a suitable source of power.

Interface Adapters

Interface bus(ses) 607 may accept, connect, and/or communicate to a number of interface adapters, conventionally although not necessarily in the form of adapter cards, such as but not limited to: input output interfaces (I/O) 608, storage interfaces 609, network interfaces 66, and/or the like. Optionally, cryptographic processor interfaces 627 similarly may be connected to the interface bus. The interface bus provides for the communications of interface adapters with one another as well as with other components of the computer systemization. Interface adapters are adapted for a compatible interface bus. Interface adapters conventionally connect to the interface bus via a slot architecture. Conventional slot architectures may be employed, such as, but not limited to: Accelerated Graphics Port (AGP), Card Bus, (Extended) Industry Standard Architecture ((E)ISA), Micro Channel Architecture (MCA), NuBus, Peripheral Component Interconnect (Extended) (PCI(X)), PCI Express, Personal Computer Memory Card International Association (PCMCIA), and/or the like.

Storage interfaces 609 may accept, communicate, and/or connect to a number of storage devices such as, but not limited to: storage devices 614, removable disc devices, and/or the like. Storage interfaces may employ connection protocols such as, but not limited to: (Ultra) (Serial) Advanced Technology Attachment (Packet Interface) ((Ultra) (Serial) ATA(PI)), (Enhanced) Integrated Drive Electronics ((E)IDE), Institute of Electrical and Electronics Engineers (IEEE) 1394, fiber channel, Small Computer Systems Interface (SCSI), Universal Serial Bus (USB), and/or the like.

Network interfaces 610 may accept, communicate, and/or connect to a communications network 613. Through the communications network 613, the SSC controller 600 is accessible through remote clients 633B (e.g., computers with web browsers) by users 633A. Network interfaces may employ connection protocols such as, but not limited to: direct connect, Ethernet (thick, thin, twisted pair 10/500/5000 Base T, and/or the like), Token Ring, wireless connection such as IEEE 802.11a-x, and/or the like. Should processing requirements dictate a greater amount speed and/or capacity, distributed network controllers (e.g., Distributed SSC system), architectures may similarly be employed to pool, load balance, and/or otherwise increase the communicative bandwidth required by the SSC controller 600. A communications network may be any one and/or the combination of the following: a direct interconnection; the Internet; a Local Area Network (LAN); a Metropolitan Area Network (MAN); an Operating Missions as Nodes on the Internet (OMNI); a secured custom connection; a Wide Area Network (WAN); a wireless network (e.g., employing protocols such as, but not limited to a Wireless Application Protocol (WAP), I-mode, and/or the like); and/or the like. A network interface may be regarded as a specialized form of an input output interface. Further, multiple network interfaces 610 may be used to engage with various communications network types 613. For example, multiple network interfaces may be employed to allow for the communication over broadcast, multicast, and/or unicast networks.

Input Output interfaces (I/O) 608 may accept, communicate, and/or connect to user input devices 611, peripheral devices 612, cryptographic processor devices 628, and/or the like. I/O may employ connection protocols such as, but not limited to: audio: analog, digital, monaural, RCA, stereo, and/or the like; data: Apple Desktop Bus (ADB), IEEE 1394a-b, serial, universal serial bus (USB); infrared; joystick; keyboard; midi; optical; PC AT; PS/2; parallel; radio; video interface: Apple Desktop Connector (ADC), BNC, coaxial, component, composite, digital, Digital Visual Interface (DVI), high-definition multimedia interface (HDMI), RCA, RF antennae, S-Video, VGA, and/or the like; wireless transceivers: 802.11a/b/g/n/x; Bluetooth; cellular (e.g., code division multiple access (CDMA), high speed packet access (HSPA(+)), high-speed downlink packet access (HSDPA), global system for mobile communications (GSM), long term evolution (LTE), WiMax, etc.); and/or the like. One typical output device may include a video display, which typically comprises a Cathode Ray Tube (CRT) or Liquid Crystal Display (LCD) based monitor with an interface (e.g., DVI circuitry and cable) that accepts signals from a video interface, may be used. The video interface composites information generated by a computer systemization and generates video signals based on the composited information in a video memory frame. Another output device is a television set, which accepts signals from a video interface. Typically, the video interface provides the composited video information through a video connection interface that accepts a video display interface (e.g., an RCA composite video connector accepting an RCA composite video cable; a DVI connector accepting a DVI display cable, etc.).

User input devices 611 often are a type of peripheral device 612 (see below) and may include: card readers, dongles, finger print readers, gloves, graphics tablets, joysticks, keyboards, microphones, mouse (mice), remote controls, retina readers, touch screens (e.g., capacitive, resistive, etc.), trackballs, trackpads, sensors (e.g., accelerometers, ambient light, GPS, gyroscopes, proximity, etc.), styluses, and/or the like.

Peripheral devices 612 may be connected and/or communicate to I/O and/or other facilities of the like such as network interfaces, storage interfaces, directly to the interface bus, system bus, the CPU, and/or the like. Peripheral devices may be external, internal and/or part of the SSC controller 600. Peripheral devices may include: antenna, audio devices (e.g., line-in, line-out, microphone input, speakers, etc.), cameras (e.g., still, video, webcam, etc.), dongles (e.g., for copy protection, ensuring secure transactions with a digital signature, and/or the like), external processors (for added capabilities; e.g., crypto devices 626), force-feedback devices (e.g., vibrating motors), network interfaces, printers, scanners, storage devices, transceivers (e.g., cellular, GPS, etc.), video devices (e.g., goggles, monitors, etc.), video sources, visors, and/or the like. Peripheral devices often include types of input devices (e.g., cameras).

It should be noted that although user input devices and peripheral devices may be employed, the SSC controller 600 may be embodied as an embedded, dedicated, and/or monitor-less (i.e., headless) device, wherein access would be provided over a network interface connection.

Cryptographic units such as, but not limited to, microcontrollers, processors 626, interfaces 627, and/or devices 628 may be attached, and/or communicate with the SSC controller 200. A MC68HC16 microcontroller, manufactured by Motorola Inc., may be used for and/or within cryptographic units. The MC68HC16 microcontroller utilizes a 16-bit multiply-and-accumulate instruction in the 16 MHz configuration and requires less than one second to perform a 512-bit RSA private key operation. Cryptographic units support the authentication of communications from interacting agents, as well as allowing for anonymous transactions. Cryptographic units may also be configured as part of the CPU. Equivalent microcontrollers and/or processors may also be used. Other commercially available specialized cryptographic processors include: Broadcom's CryptoNetX and other Security Processors; nCipher's nShield; SafeNet's Luna PCI (e.g., 7500) series; Semaphore Communications' 40 MHz Roadrunner 184; Sun's Cryptographic Accelerators (e.g., Accelerator 6000 PCIe Board, Accelerator 500 Daughtercard); Via Nano Processor (e.g., L2500, L2200, U2400) line, which is capable of performing 500+ MB/s of cryptographic instructions; VLSI Technology's 33 MHz 6868; and/or the like.

Memory

Generally, any mechanization and/or embodiment allowing a processor to affect the storage and/or retrieval of information is regarded as memory 629. However, memory is a fungible technology and resource, thus, any number of memory embodiments may be employed in lieu of or in concert with one another. It is to be understood that the SSC controller 600 and/or a computer systemization may employ various forms of memory 629. For example, a computer systemization may be configured wherein the operation of on-chip CPU memory (e.g., registers), RAM, ROM, and any other storage devices are provided by a paper punch tape or paper punch card mechanism; however, such an embodiment would result in an extremely slow rate of operation. In a typical configuration, memory 629 may include ROM 606, RAM 605, and a storage device 614. A storage device 614 may be any conventional computer system storage. Storage devices may include a drum; a (fixed and/or removable) magnetic disk drive; a magneto-optical drive; an optical drive (i.e., Blueray, CD ROM/RAM/Recordable (R)/Re-Writable (RW), DVD R/RW, HD DVD R/RW etc.); an array of devices (e.g., Redundant Array of Independent Disks (RAID)); solid state memory devices (USB memory, solid state drives (SSD), etc.); other processor-readable storage mediums; and/or other devices of the like. Thus, a computer systemization generally requires and makes use of memory.

Component Collection

The memory 629 may contain a collection of program and/or database components and/or data such as, but not limited to: operating system component(s) 615 (operating system); information server component(s) 616 (information server); user interface component(s) 617 (user interface); Web browser component(s) 618 (Web browser); SSC database(s) 619; mail server component(s) 621; mail client component(s) 622; cryptographic server component(s) 620 (cryptographic server); the SSC component(s) 635; the downmixing component 641; the reproduction component 642; the post-filtering component 643; the DOA estimation component 643; the DOA estimation component 644, the source separation component 645; the source counting component 646; and the other component(s) 647, and/or the like (i.e., collectively a component collection). These components may be stored and accessed from the storage devices and/or from storage devices accessible through an interface bus. Although non-conventional program components such as those in the component collection, typically, are stored in a local storage device 614, they may also be loaded and/or stored in memory such as: peripheral devices, RAM, remote storage facilities through a communications network, ROM, various forms of memory, and/or the like.

Operating System

The operating system component 615 is an executable program component facilitating the operation of the SSC controller 600. Typically, the operating system facilitates access of I/O, network interfaces, peripheral devices, storage devices, and/or the like. The operating system may be a highly fault tolerant, scalable, and secure system such as: Apple Macintosh OS X (Server); AT&T Plan 9; Be OS; Unix and Unix-like system distributions (such as AT&T's UNIX; Berkley Software Distribution (BSD) variations such as FreeBSD, NetBSD, OpenBSD, and/or the like; Linux distributions such as Red Hat, Ubuntu, and/or the like); and/or the like operating systems. However, more limited and/or less secure operating systems also may be employed such as Apple Macintosh OS, IBM OS/2, Microsoft DOS, Microsoft Windows 2000/2003/3.1/95/98/CE/Millenium/NT/Vista/XP (Server), Palm OS, and/or the like. An operating system may communicate to and/or with other components in a component collection, including itself, and/or the like. Most frequently, the operating system communicates with other program components, user interfaces, and/or the like. For example, the operating system may contain, communicate, generate, obtain, and/or provide program component, system, user, and/or data communications, requests, and/or responses. The operating system, once executed by the CPU, may enable the interaction with communications networks, data, I/O, peripheral devices, program components, memory, user input devices, and/or the like. The operating system may provide communications protocols that allow the SSC controller to communicate with other entities through a communications network 613. Various communication protocols may be used by the SSC controller 600 as a subcarrier transport mechanism for interaction, such as, but not limited to: multicast, TCP/IP, UDP, unicast, and/or the like.

Information Server

An information server component 616 is a stored program component that is executed by a CPU. The information server may be a conventional Internet information server such as, but not limited to Apache Software Foundation's Apache, Microsoft's Internet Information Server, and/or the like. The information server may allow for the execution of program components through facilities such as Active Server Page (ASP), ActiveX, (ANSI) (Objective-) C (++), C# and/or .NET, Common Gateway Interface (CGI) scripts, dynamic (D) hypertext markup language (HTML), FLASH, Java, JavaScript, Practical Extraction Report Language (PERL), Hypertext Pre-Processor (PHP), pipes, Python, wireless application protocol (WAP), WebObjects, and/or the like. The information server may support secure communications protocols such as, but not limited to, File Transfer Protocol (FTP); HyperText Transfer Protocol (HTTP); Secure Hypertext Transfer Protocol (HTTPS), Secure Socket Layer (SSL), messaging protocols (e.g., America Online (AOL) Instant Messenger (AIM), Application Exchange (APEX), ICQ, Internet Relay Chat (IRC), Microsoft Network (MSN) Messenger Service, Presence and Instant Messaging Protocol (PRIM), Internet Engineering Task Force's (IETF's) Session Initiation Protocol (SIP), SIP for Instant Messaging and Presence Leveraging Extensions (SIMPLE), open XML-based Extensible Messaging and Presence Protocol (XMPP) (i.e., Jabber or Open Mobile Alliance's (OMA's) Instant Messaging and Presence Service (IMPS)), Yahoo! Instant Messenger Service, and/or the like. The information server provides results in the form of Web pages to Web browsers, and allows for the manipulated generation of the Web pages through interaction with other program components. After a Domain Name System (DNS) resolution portion of an HTTP request is resolved to a particular information server, the information server resolves requests for information at specified locations on the SSC controller 200 based on the remainder of the HTTP request. For example, a request such as http://123.124.125.526/myInformation.html might have the IP portion of the request "123.124.125.526" resolved by a DNS server to an information server at that IP address; that information server might in turn further parse the http request for the "/myInformation.html" portion of the request and resolve it to a location in memory containing the information "myInformation.html." Additionally, other information serving protocols may be employed across various ports, e.g., FTP communications across port 21, and/or the like. An information server may communicate to and/or with other components in a component collection, including itself, and/or facilities of the like. Most frequently, the information server communicates with the SSC database 619, operating systems, other program components, user interfaces, Web browsers, and/or the like.

Access to the SSC system database may be achieved through a number of database bridge mechanisms such as through scripting languages as enumerated below (e.g., CGI) and through inter-application communication channels as enumerated below (e.g., CORBA, WebObjects, etc.). Any data requests through a Web browser are parsed through the bridge mechanism into appropriate grammars as required by the SSC system. In one embodiment, the information server would provide a Web form accessible by a Web browser. Entries made into supplied fields in the Web form are tagged as having been entered into the particular fields, and parsed as such. The entered terms are then passed along with the field tags, which act to instruct the parser to generate queries directed to appropriate tables and/or fields. In one embodiment, the parser may generate queries in standard SQL by instantiating a search string with the proper join/select commands based on the tagged text entries, wherein the resulting command is provided over the bridge mechanism to the SSC system as a query. Upon generating query results from the query, the results are passed over the bridge mechanism, and may be parsed for formatting and generation of a new results Web page by the bridge mechanism. Such a new results Web page is then provided to the information server, which may supply it to the requesting Web browser.

Also, an information server may contain, communicate, generate, obtain, and/or provide program component, system, user, and/or data communications, requests, and/or responses.

User Interface

Computer interfaces in some respects are similar to automobile operation interfaces. Automobile operation interface elements such as steering wheels, gearshifts, and speedometers facilitate the access, operation, and display of automobile resources, and status. Computer interaction interface elements such as check boxes, cursors, menus, scrollers, and windows (collectively and commonly referred to as widgets) similarly facilitate the access, capabilities, operation, and display of data and computer hardware and operating system resources, and status. Operation interfaces are commonly called user interfaces. Graphical user interfaces (GUIs) such as the Apple Macintosh Operating System's Aqua, IBM's OS/2, Microsoft's Windows 2000/2003/3.1/95/98/CE/Millenium/NT/XP/Vista/7 (i.e., Aero), Unix's X-Windows (e.g., which may include additional Unix graphic interface libraries and layers such as K Desktop Environment (KDE), mythTV and GNU Network Object Model Environment (GNOME)), web interface libraries (e.g., ActiveX, AJAX, (D)HTML, FLASH, Java, JavaScript, etc. interface libraries such as, but not limited to, Dojo, jQuery(UI), MooTools, Prototype, script.aculo.us, SWFObject, Yahoo! User Interface, any of which may be used and) provide a baseline and means of accessing and displaying information graphically to users.

A user interface component 617 is a stored program component that is executed by a CPU. The user interface may be a conventional graphic user interface as provided by, with, and/or atop operating systems and/or operating environments such as already discussed. The user interface may allow for the display, execution, interaction, manipulation, and/or operation of program components and/or system facilities through textual and/or graphical facilities. The user interface provides a facility through which users may affect, interact, and/or operate a computer system. A user interface may communicate to and/or with other components in a component collection, including itself, and/or facilities of the like. Most frequently, the user interface communicates with operating systems, other program components, and/or the like. The user interface may contain, communicate, generate, obtain, and/or provide program component, system, user, and/or data communications, requests, and/or responses.

Web Browser

A Web browser component 618 is a stored program component that is executed by a CPU. The Web browser may be a conventional hypertext viewing application such as Microsoft Internet Explorer or Netscape Navigator. Secure Web browsing may be supplied with 528 bit (or greater) encryption by way of HTTPS, SSL, and/or the like. Web browsers allowing for the execution of program components through facilities such as ActiveX, AJAX, (D)HTML, FLASH, Java, JavaScript, web browser plug-in APIs (e.g., FireFox, Safari Plug-in, and/or the like APIs), and/or the like. Web browsers and like information access tools may be integrated into PDAs, cellular telephones, and/or other mobile devices. A Web browser may communicate to and/or with other components in a component collection, including itself, and/or facilities of the like. Most frequently, the Web browser communicates with information servers, operating systems, integrated program components (e.g., plug-ins), and/or the like; e.g., it may contain, communicate, generate, obtain, and/or provide program component, system, user, and/or data communications, requests, and/or responses. Also, in place of a Web browser and information server, a combined application may be developed to perform similar operations of both. The combined application would similarly affect the obtaining and the provision of information to users, user agents, and/or the like from the SSC system enabled nodes. The combined application may be nugatory on systems employing standard Web browsers.

Mail Server

A mail server component 621 is a stored program component that is executed by a CPU 203. The mail server may be a conventional Internet mail server such as, but not limited to sendmail, Microsoft Exchange, and/or the like. The mail server may allow for the execution of program components through facilities such as ASP, ActiveX, (ANSI) (Objective-) C (++), C# and/or .NET, CGI scripts, Java, JavaScript, PERL, PHP, pipes, Python, WebObjects, and/or the like. The mail server may support communications protocols such as, but not limited to: Internet message access protocol (IMAP), Messaging Application Programming Interface (MAPI)/Microsoft Exchange, post office protocol (POP3), simple mail transfer protocol (SMTP), and/or the like. The mail server can route, forward, and process incoming and outgoing mail messages that have been sent, relayed and/or otherwise traversing through and/or to the SSC system.

Access to the SSC system mail may be achieved through a number of APIs offered by the individual Web server components and/or the operating system.

Also, a mail server may contain, communicate, generate, obtain, and/or provide program component, system, user, and/or data communications, requests, information, and/or responses.

Mail Client

A mail client component 622 is a stored program component that is executed by a CPU 503. The mail client may be a conventional mail viewing application such as Apple Mail, Microsoft Entourage, Microsoft Outlook, Microsoft Outlook Express, Mozilla, Thunderbird, and/or the like. Mail clients may support a number of transfer protocols, such as: IMAP, Microsoft Exchange, POP3, SMTP, and/or the like. A mail client may communicate to and/or with other components in a component collection, including itself, and/or facilities of the like. Most frequently, the mail client communicates with mail servers, operating systems, other mail clients, and/or the like; e.g., it may contain, communicate, generate, obtain, and/or provide program component, system, user, and/or data communications, requests, information, and/or responses. Generally, the mail client provides a facility to compose and transmit electronic mail messages.

Cryptographic Server

A cryptographic server component 620 is a stored program component that is executed by a CPU 503, cryptographic processor 626, cryptographic processor interface 627, cryptographic processor device 628, and/or the like. Cryptographic processor interfaces may allow for expedition of encryption and/or decryption requests by the cryptographic component; however, the cryptographic component, alternatively, may run on a conventional CPU. The cryptographic component allows for the encryption and/or decryption of provided data. The cryptographic component allows for both symmetric and asymmetric (e.g., Pretty Good Protection (PGP)) encryption and/or decryption. The cryptographic component may employ cryptographic techniques such as, but not limited to: digital certificates (e.g., X.509 authentication framework), digital signatures, dual signatures, enveloping, password access protection, public key management, and/or the like. The cryptographic component may facilitate numerous (encryption and/or decryption) security protocols such as, but not limited to: checksum, Data Encryption Standard (DES), Elliptical Curve Encryption (ECC), International Data Encryption Algorithm (IDEA), Message Digest 5 (MD5, which is a one way hash operation), passwords, Rivest Cipher (RC5), Rijndael, RSA (which is an Internet encryption and authentication system that uses an algorithm developed in 1977 by Ron Rivest, Adi Shamir, and Leonard Adleman), Secure Hash Algorithm (SHA), Secure Socket Layer (SSL), Secure Hypertext Transfer Protocol (HTTPS), and/or the like. Employing such encryption security protocols, the SSC system may encrypt all incoming and/or outgoing communications and may serve as node within a virtual private network (VPN) with a wider communications network. The cryptographic component facilitates the process of "security authorization" whereby access to a resource is inhibited by a security protocol wherein the cryptographic component effects authorized access to the secured resource. In addition, the cryptographic component may provide unique identifiers of content, e.g., employing and MD5 hash to obtain a unique signature for an digital audio file. A cryptographic component may communicate to and/or with other components in a component collection, including itself, and/or facilities of the like. The cryptographic component supports encryption schemes allowing for the secure transmission of information across a communications network to enable the SSC system component to engage in secure transactions if so desired. The cryptographic component facilitates the secure accessing of resources on the SSC system and facilitates the access of secured resources on remote systems; i.e., it may act as a client and/or server of secured resources. Most frequently, the cryptographic component communicates with information servers, operating systems, other program components, and/or the like. The cryptographic component may contain, communicate, generate, obtain, and/or provide program component, system, user, and/or data communications, requests, and/or responses.

SSC Database

The SSC database component 619 may be embodied in a database and its stored data. The database is a stored program component, which is executed by the CPU; the stored program component portion configuring the CPU to process the stored data. The database may be a conventional, fault tolerant, relational, scalable, secure database such as Oracle or Sybase. Relational databases are an extension of a flat file. Relational databases consist of a series of related tables. The tables are interconnected via a key field. Use of the key field allows the combination of the tables by indexing against the key field; i.e., the key fields act as dimensional pivot points for combining information from various tables. Relationships generally identify links maintained between tables by matching primary keys. Primary keys represent fields that uniquely identify the rows of a table in a relational database. More precisely, they uniquely identify rows of a table on the "one" side of a one-to-many relationship.

Alternatively, the SSC database may be implemented using various standard data-structures, such as an array, hash, (linked) list, struct, structured text file (e.g., XML), table, and/or the like. Such data-structures may be stored in memory and/or in (structured) files. In another alternative, an object-oriented database may be used, such as Frontier, ObjectStore, Poet, Zope, and/or the like. Object databases can include a number of object collections that are grouped and/or linked together by common attributes; they may be related to other object collections by some common attributes. Object-oriented databases perform similarly to relational databases with the exception that objects are not just pieces of data but may have other types of capabilities encapsulated within a given object. If the SSC database is implemented as a data-structure, the use of the SSC database 519 may be integrated into another component such as the SSC system component 535. Also, the database may be implemented as a mix of data structures, objects, and relational structures. Databases 619 may be consolidated and/or distributed in countless variations through standard data processing techniques. Portions of databases, e.g., tables, may be exported and/or imported and thus decentralized and/or integrated.

In one embodiment, the SSC database component 619 includes data tables 619A-F. In one embodiment, the users table 619A may include fields such as, but not limited to: user_id, ssn, dob, first_name, last_name, age, state, address_firstline, address_secondline, zipcode, contact_info, contact_ type, alt_contact_info, alt_contact_type and/or the like. The Users table may support and/or track multiple entity accounts on a SSC.

A Properties table 619B may include fields such as, but not limited to: property_ID, device_model, device_serial_number, shape_of_microphones_array, number_of_microphones, microphones_relative_positions, microphones_sensitivities, microphones_gains, microphones_electronics_delays, filters, and/or the like. The Properties table may support and/or track multiple entity accounts on a SSC.

An Options table 619C may include fields such as, but not limited to: option_ID, time-frequency_transformation_method, DOA_estimaion_method, single_source_identification_method, cross_correlation_definition, frequency_range_limits, theresholds, sources_counting_methods, filters, property_ID, user_ID and/or the like. The Options sent offers table may support and/or track multiple entity accounts on a SSC.

An Decoded Data 619D may include fields such as, but not limited to: timestamp, data_ID, channel, signal, estimated_DOAs, uncertainty, duration, frequency_range, moduli, noise_level, active_filters, option_ID, property_ID, user_ID and/or the like. The Decoded Data table may support and/or track multiple entity accounts on an SSC.

A DOA table 619E may include fields such as, but not limited to: timestamp, DOA_ID, estimated_DOA, counted_hits, tolerance, confidence_level, event_ID and/or the like. The DOA table may support and/or track multiple entity accounts on a SSC.

The other data table 619F includes all other data generated as a result of processing by modules within the SSC component 635. For example, the other data 619F may include temporary data tables, aggregated data, extracted data, mapped data, etc., encoded data, such as estimated number of sources and their DOAs. In one embodiment, the SSC database 619 may interact with other database systems. For example, employing a distributed database system, queries and data access by search SSC system component may treat the combination of the SSC database 619, an integrated data security layer database as a single database entity.

In one embodiment, user programs may contain various user interface primitives, which may serve to update the SSC system. Also, various accounts may require custom database tables depending upon the environments and the types of clients the SSC system may need to serve. It should be noted that any unique fields may be designated as a key field throughout. In an alternative embodiment, these tables have been decentralized into their own databases and their respective database controllers (i.e., individual database controllers for each of the above tables). Employing standard data processing techniques, one may further distribute the databases over several computer systemizations and/or storage devices. Similarly, configurations of the decentralized database controllers may be varied by consolidating and/or distributing the various database components 619A-F. The SSC system may be configured to keep track of various settings, inputs, and parameters via database controllers.

The SSC database 619 may communicate to and/or with other components in a component collection, including itself, and/or facilities of the like. Most frequently, the SSC database communicates with the SSC system component, other program components, and/or the like. The database may contain, retain, and provide information regarding other nodes and data.

The SSC Systems

The SSC system component 635 is a stored program component that is executed by a CPU. In one embodiment, the SSC system component incorporates any and/or all combinations of the aspects of the SSC system that was discussed in the previous figures. As such, the SSC system affects accessing, obtaining and the provision of information, services, transactions, and/or the like across various communications networks.

The SSC component may transform sound signals via SSC components into sound source(s) characterization information, and/or the like and use of the SSC. In one embodiment, the SSC component 635 takes inputs (e.g., sound signals, and/or the like) etc., and transforms the inputs via various components (e.g., Sparsifying Component 641, Cross Correlation Component 642, Single Source Segment Identification Component 643, DOA Estimation Component 644, Block Based Decision Component 645, Source Counting Component 646 and/or the like), into outputs (e.g., DOAs, number_of_sources, tolerance, confidence and/or the like).

The processing of signals for determination of source localization information may include, but is not limited to, representing the received signals in a time-frequency domain by the sparsifying component 641; detecting single-source analysis zones based at least on cross-correlations and auto-correlations between time-frequency signals from various combinations of microphone pairs (or adjacent pairs) by Single Source Segment Identification Component 643; estimating DOAs in the single-source analysis zones by the DOA Estimation Component 644; generating and/or smoothing of a histogram formed from a block of DOA estimates by Block Based Decision Component 645; and estimating the number of active sources and/or corresponding DOAs with one or more of source counting components, for example, a matching pursuit component, a peak-search component, or a linear predictive coding component, or any other Source Counting Component 646.

The SSC component 635 enabling access of information between nodes may be developed by employing standard development tools and languages such as, but not limited to: Apache components, Assembly, ActiveX, binary executables, (ANSI) (Objective–) C (++), C# and/or .NET, database adapters, CGI scripts, Java, JavaScript, mapping tools, procedural and object oriented development tools, PERL, PHP, Python, shell scripts, SQL commands, web application server extensions, web development environments and libraries (e.g., Microsoft's ActiveX; Adobe AIR, FLEX & FLASH; AJAX; (D)HTML; Dojo, Java; JavaScript; jQuery(UI); MooTools; Prototype; script.aculo.us; Simple Object Access Protocol (SOAP); SWFObject; Yahoo! User Interface; and/or the like), WebObjects, and/or the like. In one embodiment, the SSC system server employs a cryptographic server to encrypt and decrypt communications. The SSC system component may communicate to and/or with other components in a component collection, including itself, and/or facilities of the like. Most frequently, the SSC system component communicates with the SSC system database, operating systems, other program components, and/or the like. The SSC system may contain, communicate, generate, obtain, and/or provide program component, system, user, and/or data communications, requests, and/or responses.

Distributed SSC Systems

The structure and/or operation of any of the SSC system node controller components may be combined, consolidated, and/or distributed in any number of ways to facilitate development and/or deployment. Similarly, the component collection may be combined in any number of ways to facilitate deployment and/or development. To accomplish this, one may integrate the components into a common code base or in a facility that can dynamically load the components on demand in an integrated fashion.

The component collection may be consolidated and/or distributed in countless variations through standard data processing and/or development techniques. Multiple instances of any one of the program components in the program component collection may be instantiated on a single node, and/or across numerous nodes to improve performance through load-balancing and/or data-processing techniques. Furthermore, single instances may also be distributed across multiple controllers and/or storage devices; e.g., databases. All program component instances and controllers working in concert may do so through standard data processing communication techniques.

The configuration of the SSC controller 600 may depend on the context of system deployment. Factors such as, but not limited to, the budget, capacity, location, and/or use of the underlying hardware resources may affect deployment requirements and configuration. Regardless of if the configuration results in more consolidated and/or integrated program components, results in a more distributed series of program components, and/or results in some combination between a consolidated and distributed configuration, data may be communicated, obtained, and/or provided. Instances of components consolidated into a common code base from the program component collection may communicate, obtain, and/or provide data. This may be accomplished through intra-application data processing communication techniques such as, but not limited to: data referencing (e.g., pointers), internal messaging, object instance variable communication, shared memory space, variable passing, and/or the like.

If component collection components are discrete, separate, and/or external to one another, then communicating, obtaining, and/or providing data with and/or to other component components may be accomplished through inter-application data processing communication techniques such as, but not limited to: Application Program Interfaces (API) information passage; (distributed) Component Object Model ((D)COM), (Distributed) Object Linking and Embedding ((D)OLE), and/or the like), Common Object Request Broker Architecture (CORBA), Jini local and remote application program interfaces, JavaScript Object Notation (JSON), Remote Method Invocation (RMI), SOAP, process pipes, shared files, and/or the like. Messages sent between discrete component components for inter-application communication or within memory spaces of a singular component for intra-application communication may be facilitated through the creation and parsing of a grammar. A grammar may be developed by using development tools such as lex, yacc, XML, and/or the like, which allow for grammar generation and parsing capabilities, which in turn may form the basis of communication messages within and between components.

For example, a grammar may be arranged to recognize the tokens of an HTTP post command, e.g.:

w3c -post http:// . . . Value1 where Value1 is discerned as being a parameter because "http://" is part of the grammar syntax, and what follows is considered part of the post value. Similarly, with such a grammar, a variable "Value1" may be inserted into an "http://" post command and then sent. The grammar syntax itself may be presented as structured data that is interpreted and/or otherwise used to generate the parsing mechanism (e.g., a syntax description text file as processed by lex, yacc, etc.). Also, once the parsing mechanism is generated and/or instantiated, it itself may process and/or parse structured data such as, but not limited to: character (e.g., tab) delineated text, HTML, structured text streams, XML, and/or the like structured data. In another embodiment, inter-application data processing protocols themselves may have integrated and/or readily available parsers (e.g., JSON, SOAP, and/or like parsers) that may be employed to parse (e.g., communications) data. Further, the parsing grammar may be used beyond message parsing, but may also be used to parse: databases, data collections, data stores, structured data, and/or the like. Again, the desired configuration may depend upon the context, environment, and requirements of system deployment.

For example, in some implementations, the SSC controller may be executing a PHP script implementing a Secure Sockets Layer ("SSL") socket server via the information server, which listens to incoming communications on a server port to which a client may send data, e.g., data encoded in JSON format. Upon identifying an incoming communication, the PHP script may read the incoming message from the client device, parse the received JSON-encoded text data to extract information from the JSON-encoded text data into PHP script variables, and store the data (e.g., client identifying information, etc.) and/or extracted information in a relational database accessible using the Structured Query Language ("SQL"). An exemplary listing, written substantially in the form of PHP/SQL commands, to accept JSON-encoded input data from a client device via a SSL connection, parse the data to extract variables, and store the data to a database, is provided below:

```
<?PHP
header('Content-Type: text/plain');
// set ip address and port to listen to for incoming data
$address='192.168.0.500';
$port=255;
// create a server-side SSL socket, listen for/accept incoming communication
$sock=socket_create(AF_INET, SOCK_STREAM, 0);
socket_bind($sock, $address, $port) or die('Could not bind to address');
socket_listen($sock);
$client=socket_accept($sock);
// read input data from client device in 5024 byte blocks until end of message
do {
  $input=
  $input=socket_read($client, 5024);
  $data .=$input;
} while($input !=" ");
// parse data to extract variables
$obj=json_decode($data, true);
// store input data in a database
mysql_connect("201.408.185.132",$DBserver,$password); // access database server
mysql_select("CLIENT_DB.SQL"); // select database to append
mysql_query("INSERT INTO UserTable (transmission)
VALUES ($data)"); // add data to UserTable table in a CLIENT database
mysql_close("CLIENT_DB.SQL"); // close connection to database
?>
```

Also, the following resources may be used to provide example embodiments regarding SOAP parser implementation:

http://www.xav.com/perl/site/lib/SOAP/Parser.html http://publib.boulder.ibm.com/infocenter/tivihelp/v2r1/index.jsp?topic=/com.ibm.IBMDI.doc/referenceguide295.htm and other parser implementations:

http://publib.boulder.ibm.com/infocenter/tivihelp/v2r1/index.jsp?topic=/com.ibm.IBMDI.doc/referenceguide259.htm all of which are hereby expressly incorporated by reference.

In order to address various issues and advance the art, the entirety of this application for SPATIAL SOUND CHARACTERIZATION APPARATUSES, METHODS, AND SYSTEMS (including the Cover Page, Title, Headings, Field, Background, Summary, Brief Description of the Drawings, Detailed Description, Claims, Abstract, Figures, Appendices, and otherwise) shows, by way of illustration, various embodiments in which the claimed present subject matters may be practiced. The advantages and features of the application are of a representative sample of embodiments only, and are not exhaustive and/or exclusive. They are presented only to assist in understanding and teach the claimed principles. It should be understood that they are not representative of all claimed present subject matters. As such, certain aspects of the disclosure have not been discussed herein. That alternative embodiments may not have been presented for a specific portion of the present subject matter or that further undescribed alternate embodiments may be available for a portion is not to be considered a disclaimer of those alternate embodiments. It may be appreciated that many of those undescribed embodiments incorporate the same principles of the present subject matters and others are equivalent. Thus, it is to be understood that other embodiments may be utilized and functional, logical, operational, organizational, structural and/or topological modifications may be made without departing from the scope and/or spirit of the disclosure. As such, all examples and/or embodiments are deemed to be non-limiting throughout this disclosure. Also, no inference should be drawn regarding those embodiments discussed herein relative to those not discussed herein other than it is as such for purposes of reducing space and repetition. For instance, it is to be understood that the logical and/or topological structure of any combination of any program components (a component collection), other components and/or any present feature sets as described in the figures and/or throughout are not limited to a fixed operating order and/or arrangement, but rather, any disclosed order is exemplary and all equivalents, regardless of order, are contemplated by the disclosure. Furthermore, it is to be understood that such features are not limited to serial execution, but rather, any number of threads, processes, services, servers, and/or the like that may execute asynchronously, concurrently, in parallel, simultaneously, synchronously, and/or the like are contemplated by the disclosure. As such, some of these features may be mutually contradictory, in that they cannot be simultaneously present in a single embodiment. Similarly, some features are applicable to one aspect of the present subject matter, and inapplicable to others. In addition, the disclosure includes other present subject matters not presently claimed. Applicant reserves all rights in those presently unclaimed present subject matters including the right to claim such present subject matters, file additional applications, continuations, continuations in part, divisions, and/or the like thereof. As such, it should be understood that advantages, embodiments, examples, functional, features, logical, operational, organizational, structural, topological, and/or other aspects of the disclosure are not to be considered limitations on the disclosure as defined by the claims or limitations on equivalents to the claims. It is to be understood that, depending on the particular needs and/or characteristics of a SSC system individual and/or enterprise user, database configuration and/or relational model, data type, data transmission and/or network framework, syntax structure, and/or the like, various embodiments of the SSC system, may be implemented that enable a great deal of flexibility and customization. For example, aspects of the SSC system may be adapted for scoring executions in alternate trading systems. While various embodiments and discussions of the SSC system may have included reference to information security, it is to be understood that the embodiments described herein may be readily configured and/or customized for a wide variety of other applications and/or implementations.

What is claimed is:

1. A processor-implemented method for spatial sound characterization, the method comprising:

segmenting, via a processor, each of a plurality of source signals detected by a plurality of sensing devices, into one or more time frames;

for each time frame, deriving, via the processor, time-frequency transform of the source signals;

obtaining an estimated number of sources; and obtaining at least one estimated direction of arrival corresponding to each of the source signals;

extracting, via the processor and using one or more beamformers, spatially separated source signals based at least on the estimated direction of arrival and the estimated number of sources; and processing, via the processor, spatially separated source signals to yield at least one reference signal and side information; and encoding the side information, wherein the encoding includes:

arranging the estimated sources according to an assigned number of frequency bins;

based on orthogonality, encoding one or more binary masks of each sound source; and inserting the binary masks in a bitstream as encoded side information.

2. The method of claim 1 further comprising filtering the spatially separated source signals based at least on W-disjoint orthogonality conditions.

3. The method of claim 2, wherein filtering includes assigning a time-frequency element to a specific source based on energy of spatially separated source signals.

4. The method of claim 1, wherein the number of binary masks varies based on the estimated number of sources.

5. The method of claim 1, wherein the number of beamformers is calculated based on the estimated number of sources.

6. The method of claim 1 further comprising incorporating diffuse sound.

7. The method of claim 6, wherein the diffuse sound is based on at least one of a beamformer cutoff frequency and a user-defined cutoff frequency.

8. The method of claim 1 further comprising encoding the reference signal.

9. The method of claim 1, wherein estimating the number of sound sources includes:

detecting one or more single-source analysis zones based at least on a correlation between the time-frequency transform of the source signals;

estimating at least one direction of arrival for each source in the detected single source analysis zones; and creating a histogram of the estimated directions of arrival from a plurality of sources.

10. The method of claim 1, wherein obtaining the direction of arrival includes receiving the direction of arrival from a user.

11. A system for spatial sound characterization, the system comprising:

a processor;

a memory coupled to the processor, the memory comprising, a TF transform module configured to segment each of a plurality of source signals detected by a plurality of sensing devices into a plurality of time frames and provide time-frequency transform of the segmented signals;

a DOA estimator and source counter configured to obtain at least one estimated direction of arrival for each source and an estimated number of sound sources;

a source separation unit including one or more beamformers configured to extract source signals by spatial separation based at least on the estimated directions of arrival and the estimated number of sources;

a post-filter configured to filter the spatially separated source signals based at least on orthogonality conditions, wherein the post-filter is further configured to filter the spatially separated source signals based at least on binary masks; and a reference signal generator configured to yield a reference signal and side information, based at least on the spatially separated source signals, and to encode the side information by:

arranging the estimated sources according to an assigned number of frequency bins; and inserting the binary masks in a bitstream as encoded side information.

12. The system of claim 11 wherein the post-filter is configured to filter the spatially separated source signals based at least on W-disjoint orthogonality conditions.

13. The system of claim 12, wherein the configuration of the binary masks varies based on the estimated number of sources.

14. The system of claim 11, wherein the configuration of beamformers is calculated based on the estimated number of sources.

15. The system of claim 14 further comprising incorporating diffuse sound, wherein the diffuse sound is based on at least one of a beamformer cutoff frequency and a user-defined cutoff frequency.

16. A non-transitory computer-readable medium storing instructions that, when executed by a processor, cause the processor to perform operations for sound characterization, the operations comprising:

segmenting, via a processor, each of a plurality of source signals detected by a plurality of sensing devices, into a plurality of time frames;

for each time frame, deriving, via the processor, time-frequency transform of the source signals;

obtaining an estimated number of estimated sources; and obtaining at least one estimated direction of arrival corresponding to each of the source signals;

extracting, via the processor and using one or more beamformers, spatially separated source signals based at least on the estimated direction of arrival and the estimated number of sources;

filtering the spatially separated source signals based at least on W-disjoint orthogonality conditions;

processing, via the processor, spatially separated source signals to yield a reference signal and side information; and encoding the side information, wherein the encoding includes:

arranging the estimated sources according to an assigned number of frequency bins;

encoding one or more binary masks of each sound source based on the W-disjoint orthogonality conditions; and inserting the one or more binary masks in a bitstream as encoded side information.

17. A processor-implemented method for decoding spatial sound, the method comprising:

receiving, via a processor, a reference signal and side information corresponding to a plurality of encoded source signals;

deriving, via the processor, time-frequency transform of the reference signal;

if the reference signal includes a non-diffuse part, generating the non-diffuse part according to a corresponding estimated direction of arrival, wherein the estimated direction of arrival is based on the side information; and determining whether diffuse sound is incorporated; and if the determination is positive, implementing at least one of: a diffuse field head-related transfer function filtering; and scaling the reference signal by the square root of the number of output audio channels; to generate the diffuse part; and adding the diffuse part with the non-diffuse part.

18. The method of claim 17, wherein generating the non-diffuse part further comprises generating the non-diffuse part based on at least on one of amplitude panning and a head-related transfer function.

19. The method of claim 17 further comprising decoding the side information, wherein decoding includes retrieving binary masks corresponding to one or more sources and mapping, and retrieving a look-up table that associates the sources with their corresponding directions of arrival.

20. The method of claim 17 further comprising selecting one or more sources from amongst a plurality of sources by attenuating, muting or enhancing sources based on the estimated direction of arrival.

* * * * *